US008531443B2

(12) United States Patent
Yanagawa et al.

(10) Patent No.: US 8,531,443 B2
(45) Date of Patent: Sep. 10, 2013

(54) DISPLAY DRIVING CIRCUIT, DISPLAY DEVICE, AND DISPLAY DRIVING METHOD

(75) Inventors: Takayuki Yanagawa, Osaka (JP); Atsushi Okada, Osaka (JP); Yasushi Sasaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 249 days.

(21) Appl. No.: 13/062,549

(22) PCT Filed: Jun. 22, 2009

(86) PCT No.: PCT/JP2009/061303

§ 371 (c)(1),
(2), (4) Date: Mar. 7, 2011

(87) PCT Pub. No.: WO2010/032526

PCT Pub. Date: Mar. 25, 2010

(65) Prior Publication Data

US 2011/0169790 A1 Jul. 14, 2011

(30) Foreign Application Priority Data

Sep. 16, 2008 (JP) ..... 2008-236908

(51) Int. Cl.
*G09G 3/36* (2006.01)
*G09G 5/00* (2006.01)

(52) U.S. Cl.
USPC ..... 345/205; 345/100

(58) Field of Classification Search
USPC ..... 345/204
See application file for complete search history.

(56) References Cited

U.S. PATENT DOCUMENTS

| | | | | |
|---|---|---|---|---|
| 6,069,605 | A * | 5/2000 | Ozawa | 345/98 |
| 6,084,562 | A | 7/2000 | Onda | |
| 7,355,575 | B1 | 4/2008 | Ota et al. | |
| 2002/0084970 | A1 | 7/2002 | Ozawa | |

(Continued)

FOREIGN PATENT DOCUMENTS

| | | | |
|---|---|---|---|
| JP | 4-145490 | A | 5/1992 |
| JP | 6-265846 | A | 9/1994 |

(Continued)

OTHER PUBLICATIONS

Office Action dated Jan. 24, 2012 for U.S. Appl. No. 12/452,512.

(Continued)

*Primary Examiner* — Dorothy Harris
(74) *Attorney, Agent, or Firm* — Birch Stewart Kolasch & Birch, LLP

(57) ABSTRACT

Provided is a display driving circuit eliminating occurrence of lateral stripes in the first frame from which display corresponding to a video signal is started in CC driving premised on line inversion driving. A source bus line drive circuit outputs a source signal whose polarity is reversed in sync with horizontal scanning period for each row and whose polarity is opposite in an adjacent horizontal scanning period on the same row. A CS bus line drive circuit outputs, after the horizontal scanning period for each row, a CS signal with potential switched along a direction according to polarity of the source signal in the horizontal scanning period concerned. The CS bus line drive circuit outputs the CS signal in a first frame so that potential of the CS signal when the switching element on one row is switched is different from potential of a CS signal on an adjacent row.

10 Claims, 12 Drawing Sheets

(56) References Cited

U.S. PATENT DOCUMENTS

| | | | | |
|---|---|---|---|---|
| 2003/0179172 | A1 | 9/2003 | Miyachi | |
| 2005/0036078 | A1 | 2/2005 | Tsunashima et al. | |
| 2005/0122441 | A1 | 6/2005 | Shimoshikiryoh | |
| 2006/0181498 | A1 | 8/2006 | Toyozawa et al. | |
| 2007/0075956 | A1 | 4/2007 | Satou et al. | |
| 2007/0188431 | A1* | 8/2007 | Sato et al. | 345/90 |
| 2008/0204444 | A1* | 8/2008 | Ryu et al. | 345/214 |

FOREIGN PATENT DOCUMENTS

| | | | |
|---|---|---|---|
| JP | 2001-083943 | A | 3/2001 |
| JP | 2003-279929 | A | 10/2003 |
| JP | 2004-226785 | A | 8/2004 |
| JP | 2005-049849 | A | 2/2005 |
| JP | 2007-47703 | A | 2/2007 |
| JP | 2009-116122 | A | 5/2009 |
| WO | WO 2005/045795 | A1 | 5/2005 |
| WO | WO 2009/050926 | A1 | 4/2009 |

OTHER PUBLICATIONS

U.S. Notice of Allowance dated Aug. 21, 2012 from co-pending U.S. Appl. No. 12/452,512.

M. Rafiquzzaman: "Sequential Logic Design" Jun. 29, 2005, pp. 135-184.

Office Action dated Apr. 30, 2012 for U.S. Appl. No. 12/452,512.

International Search Report, dated Jul. 14, 2009, issued in PCT/JP2009/061303.

* cited by examiner

DISPLAY DRIVING CIRCUIT, DISPLAY DEVICE, AND DISPLAY DRIVING METHOD

TECHNICAL FIELD

The present invention relates to driving of a display device such as a liquid crystal display device including an active matrix liquid crystal display panel. In particular, the present invention relates to a display driving circuit and a display driving method both for driving a display panel of a display device which employs a driving method referred to as "charge coupling (CC) driving."

BACKGROUND ART

CC driving method which has conventionally been employed in an active matrix liquid crystal display device is disclosed in, for example, Patent Literature 1. The following description first deals with CC driving with reference to the disclosure of Patent Literature 1 as an example.

FIG. 11 illustrates a configuration of a liquid crystal display device which carries out CC driving. FIG. 12 illustrates respective operating waveforms of various signals involved in the CC driving carried out by the liquid crystal display device of FIG. 11.

As illustrated in FIG. 11, the liquid crystal display device that carries out CC driving includes: an image display section 110; a source line driving circuit 111; a gate line driving circuit 112; and a CS bus line driving circuit 113.

The image display section 110 includes: a plurality of source lines (signal lines) 101; a plurality of gate lines (scan lines) 102; switching elements 103; pixel electrodes 104; a plurality of CS (capacity storage) bus lines (common electrode lines) 105; storage capacitors 106; liquid crystal sections 107; and a counter electrode 109. The switching elements 103 are provided near respective intersections of the source lines 101 with the gate lines 102. The switching elements 103 are each connected to one of the pixel electrodes 104.

The CS bus lines 105 each extend in parallel to the gate lines 102 so as to form a pair with one of the gate lines 102. The storage capacitors 106 each have (i) a first terminal connected to a corresponding one of the pixel electrodes 104 and (ii) a second terminal connected to a corresponding one of the CS bus lines 105. The counter electrode 109 is provided so as to face the pixel electrodes 104 via the respective liquid crystal sections 107.

The source line driving circuit 111 is provided so as to drive the source lines 101. The gate line driving circuit 112 is provided so as to drive the gate lines 102. The CS bus line driving circuit 113 is provided so as to drive the CS bus lines 105.

The switching elements 103 each include amorphous silicon (a-Si), polycrystalline polysilicon (p-Si), or single crystal silicon (c-Si), for example. As a result of this arrangement, a capacitor 108 is created between a gate terminal and a drain terminal of each of the switching elements 103. Because of the capacitor 108, a phenomenon occurs in which a potential of each pixel electrode 104 is shifted to a negative side by a gate pulse supplied from a corresponding one of the gate lines 102.

As illustrated in FIG. 12, a gate line 102 of the above liquid crystal display device has a potential Vg which is (i) set at Von only during its horizontal scanning period (H period), that is, only while the gate line 102 is being selected, and (ii) maintained at Voff during the other period. A corresponding source line 101 has a potential Vs having a waveform which (i) has an amplitude that differs depending on a video signal for each display and (ii) has a polarity that is reversed every H period across a central potential of a counter electrode potential Vcom and that is reversed between consecutive H periods for any given gate line 102 (line inversion driving). Note that since FIG. 12 assumes a case in which a uniform video signal is inputted, the potential Vs oscillates at a constant amplitude.

A corresponding pixel electrode 104 has a potential Vd while the potential Vg is set at Von which potential is identical to the potential Vs of the source line 101 because a corresponding switching element 103 is conductive during such a period. The potential Vd is then slightly shifted to the negative side through the gate-drain capacitor 108 at a fall of the potential Vg to Voff.

A CS bus line 105 corresponding to the gate line 102 has a potential Vc which is set at a Ve+ level during (i) a first H period, that is, while the gate line 102 is being selected, and (ii) a second H period, which is subsequent to the first H period. The potential Vc is switched to a Ve− level at the beginning of a third H period, which is subsequent to the second H period. The potential Vc is maintained at the Ve− level until the beginning of a next field. Because of the above switching, the potential Vd is shifted to the negative side through a corresponding storage capacitor 106.

With the above arrangement, the potential Vd oscillates at an amplitude larger than an amplitude of the potential Vs, and the potential Vs thus oscillates at a smaller amplitude. As such, the source line driving circuit 111 can have a simplified circuit configuration and a reduced power consumption.

CITATION LIST

Patent Literature 1

Japanese Patent Application Publication, Tokukai, No. 2001-83943 A (Publication Date: Mar. 30, 2001)

SUMMARY OF INVENTION

Technical Problem

A liquid crystal display device which employs the line inversion driving and the CC driving has a problem that alternating light and dark lateral stripes along respective rows (each corresponding to one horizontal line of the liquid crystal display device) appear in a first frame after a start of display.

FIG. 13 is a timing chart which illustrates an operation of the liquid crystal display device for an explanation of a cause of the above problem.

FIG. 13 illustrates (i) a vertical synchronizing signal Vsync which defines timing of vertical scanning and (ii) a horizontal synchronizing signal Hsync which defines timing of horizontal scanning. The vertical synchronizing signal Vsync falls a period after its immediately previous fall. This period is defined as one vertical scanning period (1V period). The horizontal synchronizing signal Hsync falls a period after its immediately previous fall. This period is defined as one horizontal scanning period (1H period). FIG. 13 further illustrates a polarity signal POL, which is a signal having a polarity that is reversed in sync with the horizontal scanning period.

FIG. 13 further illustrates, in an order presented below, a source signal S, a gate signal G1, a CS signal CS1, and a potential Vpix1 of a pixel electrode provided at an intersection of the first row with an x-th column. The source signal S is supplied from the source line driving circuit 111 to a source line 101 (that is, a source line 101 on the x-th column). The gate signal G1 is supplied from the gate line driving circuit 112 to a gate line 102 on the first row. The CS signal CS1 is supplied from the CS bus line driving circuit 113 to a CS bus line 105 on the first row.

FIG. 13 similarly illustrates, in an order presented below, (i) a gate signal G2 supplied to a gate line 102 on a second row, a CS signal CS2 supplied to a CS bus line 105 on the second row, and (iii) a potential Vpix2 of a pixel electrode provided at an intersection of the second row with the x-th column. FIG. 13 further illustrates, in an order presented below, (i) a gate signal G3 supplied to a gate line 102 on a third row, a CS signal CS3 supplied to a CS bus line 105 on the third row, and (iii) a potential Vpix3 of a pixel electrode provided at an intersection of the third row with the x-th column.

FIG. 13 shows a broken line for each of the potentials Vpix1, Vpix2, and Vpix3 to represent a potential of the counter electrode 109.

The liquid crystal display device starts operating when, for example, supplied with power, and then displays a first frame (that is, a start frame) of a display (hereinafter referred to as "video image display") corresponding to a video image to be displayed. Immediately before displaying the first frame, the liquid crystal display device is in an initial state in which it carries out no video image display (see FIG. 13). In this initial state, the source line driving circuit 111, the gate line driving circuit 112, and the CS bus line driving circuit 113 are each either in a preparatory stage prior to a normal operation or out of operation. As such, the gate signals G1, G2, and G3 are each constantly at a gate-off potential (that is, a potential for turning off a gate of each switching element 103), whereas the CS signals CS1, CS2, and CS3 are each constantly at one potential (for example, Vss).

During the first frame after the initial state, the source line driving circuit 111, the gate line driving circuit 112, and the CS bus line driving circuit 113 each carry out a normal operation. With the arrangement, the source signal S has an amplitude corresponding to a tone level represented by a video signal, and reverses its polarity every 1H period.

In FIG. 13, which assumes a display of a uniform video image, the source signal S has a constant amplitude. The gate signals G1, G2, and G3 are each at a gate-on potential (that is, a potential for turning on the gate of each switching element 103) during first, second, and third 1H periods, respectively, within the active period (effective scanning period) of each frame. The gate signals G1, G2, and G3 are each at a gate-off potential during the other period.

The CS signals CS1, CS2, and CS3 each reverse its polarity after a corresponding one of the gate signals G1, G2, and G3 falls. The CS signals CS1, CS2, and CS3 also show their respective waveforms having opposite reversal directions. Specifically, during each odd-numbered frame, the CS signals CS1 and CS3 each rise after the fall of a corresponding one of the gate signals G1 and G3, whereas the CS signal CS2 does not rise after the fall of its corresponding gate signal G2. During each even-numbered frame, the CS signals CS1 and CS3 each fall after the fall of a corresponding one of the gate signals G1 and G3, whereas the CS signal CS2 rises after the fall of its corresponding gate signal G2.

Note that the rise and fall of the CS signals CS1, CS2, and CS3 are reversible between odd-numbered frames and even-numbered frames.

The CS signals CS1, CS2, and CS3 can each reverse its polarity at any timing which follows the fall of a corresponding one of the gate signals G1, G2, and G3, that is, which follows a corresponding horizontal scanning period. For example, the CS signals CS1, CS2, and CS3 can each reverse its polarity at a moment of an end of the horizontal scanning period (that is, in sync with the fall of a corresponding gate signal).

Since the CS signals CS1, CS2, and CS3 are each constantly at one potential in the initial state, the potential Vpix2 has an irregular waveform during the first frame. Specifically, the CS signals CS1 and CS3 are each identical between the first frame and any other odd-numbered frame in that each of the CS signals CS1 and CS3 rises after the fall of a corresponding one of the gate signals G1 and G3. The CS signal CS2 is, in contrast, different between the first frame and any other odd-numbered frame in that the gate signal G2 during the first frame maintains its potential even after the fall of the corresponding gate signal G2.

During the first frame, the CS signals CS1 and CS3 supplied to pixel electrodes 104 on the first and third rows each have a potential level changed as normal. As such, the potentials Vpix1 and Vpix3 are shifted due to the respective potential level changes of the CS signals CS1 and CS3. The CS signal CS2 supplied to pixel electrodes 104 on the second row, on the other hand, does not have a potential level changed as normal. As such, the potential Vpix2 is not shifted (as indicated by a diagonally shaded area in FIG. 13). Thus, since the potentials Vpix1 and Vpix3 are different from the potential Vpix2, input of the source signal S having an identical tone level unfortunately causes a difference in luminance between (i) the first and third rows and (ii) the second row. The difference in luminance appears between the odd-numbered rows and the even-numbered rows over the image display section. As a result, alternating light and dark lateral stripes along the respective rows are observed in a video image of the first frame.

In a case where the liquid crystal display device is included in a mobile telephone as its display device, the driving method is set to the frame inversion during a conversation so as to reduce noise, because line inversion tends to cause large noise (vibration), whereas frame inversion causes only small noise. For the purpose of the reduction, the source line driving circuit 111 switches its driving method between the line inversion driving and the frame inversion driving. The source line driving circuit 111 can switch its driving method between the line inversion driving and the frame inversion driving as above so as to, for example, prevent an influence of the liquid crystal display device on other components of an apparatus in which the liquid crystal display device is incorporated.

The above problem is, however, a phenomenon peculiar to the line inversion driving, and is thus not caused during the frame inversion driving. As such, it is necessary to provide an arrangement only for the line inversion driving so as to overcome the problem.

The present invention has been accomplished in view of the above problem. It is an object of the present invention to provide a display driving circuit and a display driving method each of which (i) eliminates the appearance of the above-mentioned lateral stripes which are visible only during the line inversion driving, and thus (ii) improve display quality.

Solution to Problem

A display driving circuit of the present invention is a display driving circuit for driving a display panel, the display panel including: a plurality of rows each including: a scanning signal line; switching elements which are turned on and off with use of the scanning signal line; pixel electrodes each connected to a first terminal of a corresponding one of the switching elements; and a capacity coupling line capacitively coupled to the pixel electrodes; and data signal lines each connected to a second terminal of a corresponding one of the switching elements on the each of the plurality of rows, the display driving circuit driving the display panel to carry out a gradation display corresponding to a potential of each of the pixel electrodes, the display driving circuit including: a scanning signal line driving circuit which outputs a scanning signal for turning on the switching elements on the each of the plurality of rows during a corresponding one of horizontal scanning periods which are sequentially allocated to the respective plurality of rows; a data signal line driving circuit which outputs a data signal having a polarity that is, (i) to carry out line inversion driving, reversed in sync with a vertical scanning period, identical for all pixels on each of the plurality of rows, and reversed between any adjacent two of the plurality of rows, and (ii) to carry out frame inversion driving, reversed in sync with the vertical scanning period and identical for all pixels for an identical frame; a capacity coupling line driving circuit which, after the horizontal scanning period for the each of the plurality of rows, outputs a potential shift signal having a potential that is switched between two values in a direction determined in accordance with the polarity of the data signal which polarity corresponds to the horizontal scanning period; and a determining circuit which determines whether the data signal line driving circuit is carrying out the line inversion driving or the frame inversion driving, the capacity coupling line driving circuit outputting the potential shift signal so that only if the determining circuit has determined that the data signal line driving circuit is carrying out the line inversion driving, the potential of the potential shift signal at timing at which the switching elements on the each of the plurality of rows are turned off is different between (i) the each of the plurality of rows and (ii) a row adjacent to the each of the plurality of rows, during a first vertical scanning period in which the data signal corresponding to a video image to be displayed starts to be outputted.

The display panel driven by the display driving circuit is configured as described above. The display panel typically includes, for instance: a large number of pixel electrodes arranged in a matrix pattern; a scanning signal line, switching elements, and a capacity coupling line along each row; and a data signal line along each column. In this typical configuration, the terms "row" and "horizontal" often refer to a lateral direction of the display panel, whereas the terms "column" and "vertical" often refer to a longitudinal direction of the display panel. The present invention is, however, not necessarily limited to this, and the lateral direction and the longitudinal direction can be interchanged. Thus, none of the terms "row", "column", "horizontal", and "vertical" as used in the description of the present invention specifies a particular direction.

The display driving circuit for driving the above display panel outputs a scanning signal so as to turn on switching elements on a corresponding row during a corresponding one of the horizontal scanning periods which are sequentially allocated to the respective rows. The display driving circuit writes, to pixel electrodes connected to the respective switching elements which are turned on as above, a potential corresponding to a data signal having a polarity that is reversed in sync with the vertical scanning period, that is identical for all pixels on each row, and that is reversed between adjacent rows. As such so-called line inversion driving is carried out. Further, the display driving circuit similarly writes, to the pixel electrodes connected to the respective switching elements which are turned on as above, a potential corresponding to a data signal having a polarity that is reversed in sync with the vertical scanning period and that is identical for all pixels for an identical frame. As such so-called frame inversion driving is carried out.

The display driving circuit shifts a potential of each pixel electrode, capacitively coupled to the capacity coupling line, with use of the potential shift signal only if the determining circuit has determined that the data signal line driving circuit is carrying out the line inversion driving. The potential shift signal has a potential which is switched between two values after the horizontal scanning period for a corresponding row. The potential is switched in a direction (that is, either from the low level to the high level or from the high level to the low level) which is determined in accordance with the polarity of a data signal on the row during the horizontal scanning period. As such, so-called CC driving is carried out.

The CC driving based on the line inversion driving, as mentioned in the "Technical Problem" section above, normally causes alternating light and dark lateral stripes to appear along respective rows (lines) during the first vertical scanning period (that is, the first frame) in which the output of a data signal corresponding to a video image to be displayed starts. This is because as explained in the "Technical Problem" section, a potential shift signal (that is, the CS signals CS1 and CS2) has a waveform which is irregular during the first vertical scanning period and which is thus different between the first vertical scanning period and normal vertical scanning periods subsequent to the first vertical scanning period.

In view of this problem, the display driving circuit is arranged to cause the capacity coupling line driving circuit to output, only during the line inversion driving, a potential shift signal having a potential that is different between adjacent rows at the timing at which the switching elements on the row are turned off. With the arrangement, it is possible to (i) eliminate irregular waveforms which cause the lateral stripes during the first vertical scanning period, and thus (ii) prevent the appearance of such lateral stripes during the first vertical scanning period so as to improve display quality.

The display driving circuit may preferably be arranged such that the capacity coupling line driving circuit outputs the potential shift signal so that during the line inversion driving, the potential of the potential shift signal on the each of the plurality of rows is different between (i) timing at which the switching elements on the each of the plurality of rows are turned on and (ii) timing at which the switching elements on a row subsequent to the each of the plurality of rows are turned on.

According to the above arrangement, the potential shift signal on a corresponding row has a potential which is different between (i) the timing at which the switching elements on the row are turned on and (ii) the timing at which the switching elements on a row subsequent to the corresponding row are turned on. As such, the potential at the timing when the switching elements on the corresponding row are turned off is different between the adjacent rows.

With the arrangement, it is possible to eliminate irregular waveforms which cause the lateral stripes during the first vertical scanning period.

The display driving circuit may preferably be arranged such that the capacity coupling line driving circuit includes: a first input section which receives (i) a scanning signal on the each of the plurality of rows and (ii) a scanning signal on the row subsequent to the each of the plurality of rows; a second input section which receives a polarity signal having (i) a potential that corresponds to the potential of the potential shift signal and (ii) a polarity that is reversed in sync with the horizontal scanning period for the each of the plurality of rows; and an output section which outputs the potential shift signal for the each of the plurality of rows; and the capacity coupling line driving circuit during the line inversion driving outputs (i) a first potential shift signal having a first potential, the first potential shift signal having a polarity identical to a first polarity of the polarity signal being inputted to the second input section when the scanning signal on the each of the plurality of rows is inputted to the first input section, and (ii) a second potential shift signal having a second potential, the second potential shift signal having a polarity identical to a second polarity of the polarity signal being inputted to the second input section when the scanning signal on the row subsequent to the each of the plurality of rows is inputted to the first input section.

The display driving circuit may preferably be arranged such that the capacity coupling line driving circuit includes a D-latch circuit.

With the arrangement, it is possible, with use of a simple circuit configuration, to prevent the appearance of lateral stripes during the first vertical scanning period so as to improve display quality as described above.

The display driving circuit may preferably be arranged such that the capacity coupling line driving circuit outputs the potential shift signal so that during the line inversion driving, the potential of the potential shift signal in an initial state is different between any adjacent two of the plurality of rows.

The initial state refers to a state of the liquid crystal display device which state is observed when the liquid crystal display device is, for example, supplied with power to start its operation. In this initial state, the capacity coupling line driving circuit is either in a preparatory stage prior to a normal operation or out of operation.

According to the above arrangement, the potential shift signal has a potential level which is different between adjacent rows already in the initial state. With the arrangement, it is possible to properly start the operation of the capacity coupling line driving circuit from the first vertical scanning period. As such, it is possible to eliminate irregular waveforms which cause the lateral stripes during the first vertical scanning period.

The display driving circuit may preferably further include: a control circuit which controls the signal line driving circuit and the capacity coupling line driving circuit, wherein: the control circuit outputs, to the capacity coupling line driving circuit, a control signal having a potential that (i) is different between any adjacent two of the plurality of rows, and that (ii) corresponds to the polarity signal having a polarity that is reversed in sync with the horizontal scanning period for the each of the plurality of rows, so that during the line inversion driving, the potential of the potential shift signal in the initial state is different between any adjacent two of the plurality of rows.

According to the above arrangement, it is possible to cause the potential shift signal to have a potential level in the initial state which potential is different between adjacent rows.

With the arrangement, it is possible to eliminate irregular waveforms which cause the lateral stripes during the first vertical scanning period.

The display driving circuit may preferably be arranged such that the control circuit during the line inversion driving outputs (i) a first control signal if the polarity signal has a first polarity when a scanning signal on the each of the plurality of rows is turned on during the first vertical scanning period, and (ii) a second control signal if the polarity signal has a second polarity when the scanning signal on the each of the plurality of rows is turned on during the first vertical scanning period.

According to the above arrangement, different control signals are outputted depending on the polarity of the polarity signal. The polarity of polarity signal at the timing when a corresponding scanning signal is turned on is different between adjacent rows during the first vertical scanning period. As such, different control signals are inputted on adjacent rows. With the arrangement, it is possible to cause the potential shift signal to have a potential level in the initial state which potential is different between adjacent rows.

The display driving circuit may preferably be arranged such that the capacity coupling line driving circuit includes a D-latch circuit; and the control circuit during the line inversion driving outputs, to the capacity coupling line driving circuit, (i) a reset signal as the first control signal if the polarity signal has a negative polarity when the scanning signal on the each of the plurality of rows is turned on during the first vertical scanning period, and (ii) a set signal as the second control signal if the polarity signal has a positive polarity when the scanning signal on the each of the plurality of rows is turned on during the first vertical scanning period.

With the arrangement, it is possible, with use of a simple circuit configuration, to cause the potential shift signal to have a potential level in the initial state which potential is different between adjacent rows.

The display driving circuit may preferably be arranged such that the capacity coupling line driving circuit includes: a first input section which receives a scanning signal on a row subsequent to the each of the plurality of rows; a second input section which receives a polarity signal having (i) a potential that corresponds to the potential of the potential shift signal and (ii) a polarity that is reversed in sync with the horizontal scanning period for each of the plurality of rows; and an output section which outputs the potential shift signal for the each of the plurality of rows; and the capacity coupling line driving circuit during the line inversion driving switches the potential of the potential shift signal in accordance with the polarity of the polarity signal being inputted to the second input section when the scanning signal on the row subsequent to the each of the plurality of rows is inputted to the first input section.

According to the above arrangement, the potential shift signal has a potential which is switched in accordance with the polarity of the polarity signal being inputted to the second input section when the scanning signal on a row subsequent to a corresponding row is inputted to the first input section. In other words, it is unnecessary to take into consideration a scanning signal on the corresponding row when the potential of the potential shift signal is switched. As such, it is possible to simplify the circuit configuration.

A display device of the present invention includes: any one of the above display driving circuits; and the display panel.

According to the above arrangement, it is possible to (i) prevent the appearance of the lateral stripe with use of the display driving circuit, and thus (ii) provide a display device having good display quality.

In order to solve the above problem, a display driving method of the present invention is a display driving method for driving a display panel, the display panel including: a plurality of rows each including: a scanning signal line; switching elements which are turned on and off with use of the scanning signal line; pixel electrodes each connected to a first terminal of a corresponding one of the switching elements; and a capacity coupling line capacitively coupled to the pixel electrodes; and data signal lines each connected to a second terminal of a corresponding one of the switching elements on the each of the plurality of rows, the display driving method driving the display panel to carry out a gradation display corresponding to a potential of each of the pixel electrodes, the display driving method including: (a) a scanning signal line driving step for outputting a scanning signal for turning on the switching elements on the each of the plurality of rows during a corresponding one of horizontal scanning periods which are sequentially allocated to the respective plurality of rows; (b) a data signal line driving step for outputting a data signal having a polarity that is, (i) to carry out line inversion driving, reversed in sync with a vertical scanning period, identical for all pixels on each of the plurality of rows, and reversed between any adjacent two of the plurality of rows, and (ii) to carry out frame inversion driving, reversed in sync with the vertical scanning period and identical for all pixels for an identical frame; (c) a capacity coupling line driving step for outputting, after the horizontal scanning period for the each of the plurality of rows, a potential shift signal having a potential that is switched between two values in a direction determined in accordance with the polarity of the data signal which polarity corresponds to the horizontal scanning period; and (d) a determining step for determining whether the line inversion driving or the frame inversion driving is being carried out in the step (b), the capacity coupling line driving step outputting the potential shift signal so that only if it is determined in the step (d) that the line inversion driving is being carried out in the step (b), the potential of the potential shift signal at timing at which the switching elements on the each of the plurality of rows are turned off is different between (i) the each of the plurality of rows and (ii) a row adjacent to the each of the plurality of rows, during a first vertical scanning period in which the data signal corresponding to a video image to be displayed starts to be outputted.

According to the method, it is possible to prevent the appearance of lateral stripes during the first vertical scanning period so as to improve display quality, as in the case of the display driving circuit.

The display device of the present invention may preferably be arranged such that the display device is a liquid crystal display device.

Advantageous Effects of Invention

The display driving circuit and the display driving method of the present invention are, as described above, each arranged such that the potential shift signal is outputted so that only when the line inversion driving is being carried out or when the data signal line driving circuit, which can carry out the frame inversion driving, is carrying out the line inversion driving, the potential of the potential shift signal at timing at which the switching elements on the row are turned off is different between adjacent rows during the first vertical scanning period in which a data signal corresponding to a video image to be displayed starts to be outputted.

According to the arrangement and the method, it is possible to solve the problem that during the line inversion driving, alternating light and dark lateral stripes appear along the respective rows (lines) during the first vertical scanning period (that is, the first frame) in which the output of a data signal corresponding to a video image to be displayed starts. As such, it is possible to improve display quality.

(a) is a timing chart illustrating an operation of the CS bus line driving circuit for a case of line inversion driving, and (b) is a timing chart illustrating an operation of the CS bus line driving circuit for a case of frame inversion driving.

Figure 6:
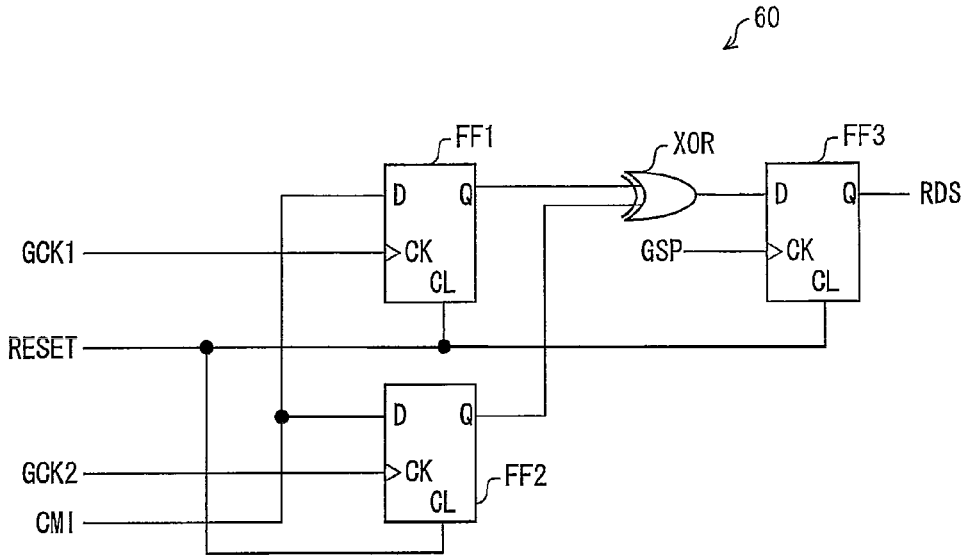

FIG. 6 is a circuit diagram illustrating a configuration of an inversion determining circuit included in the liquid crystal display device.

Figure 7:
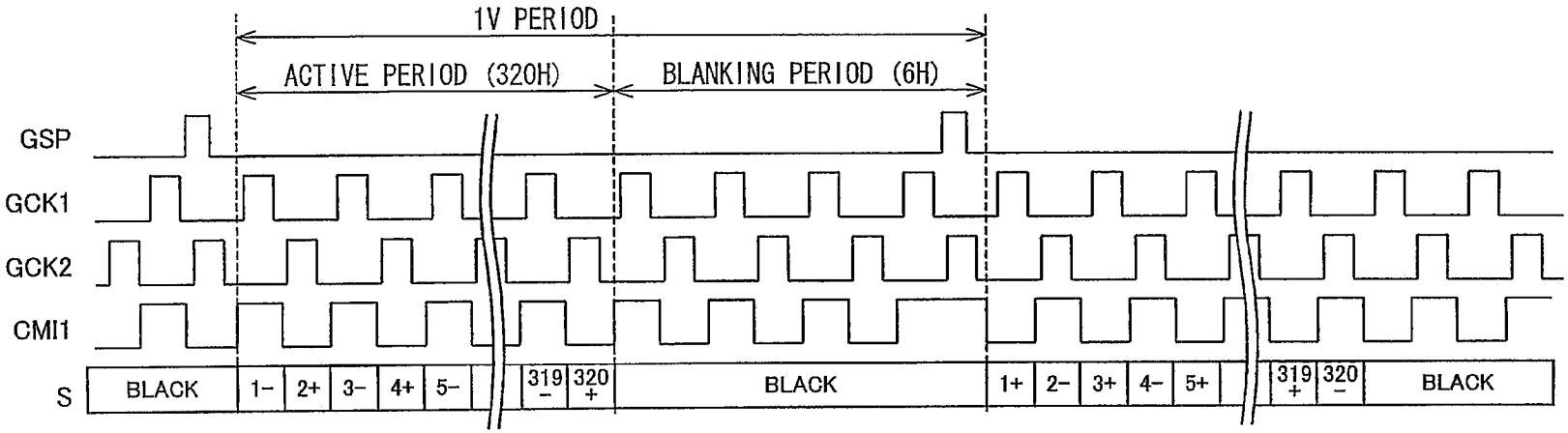

FIG. 7 is a timing chart illustrating various signals inputted to the inversion determining circuit during the line inversion driving.

Figure 8:
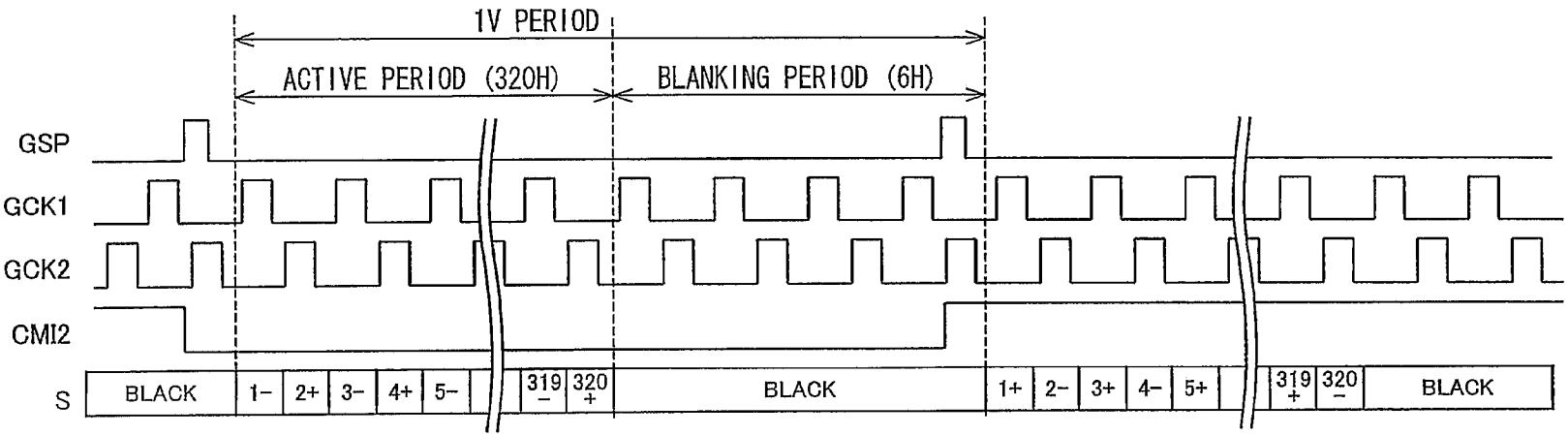

FIG. 8 is a timing chart illustrating various signals inputted to the inversion determining circuit during the frame inversion driving.

Figure 9:
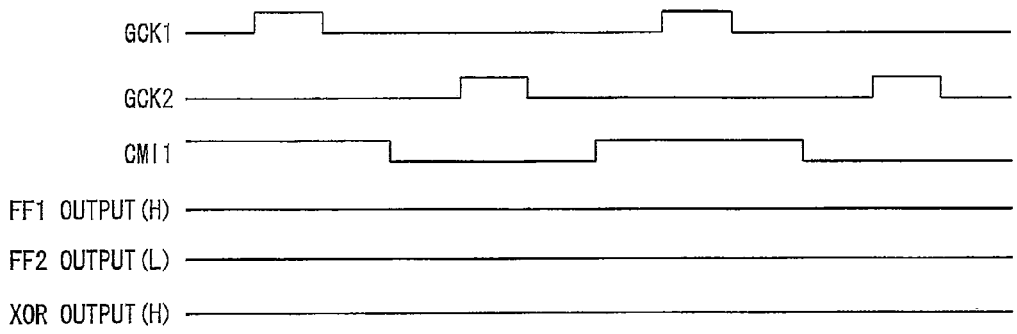

FIG. 9 is a timing chart illustrating how the inversion determining circuit operates during the line inversion driving.

Figure 10:
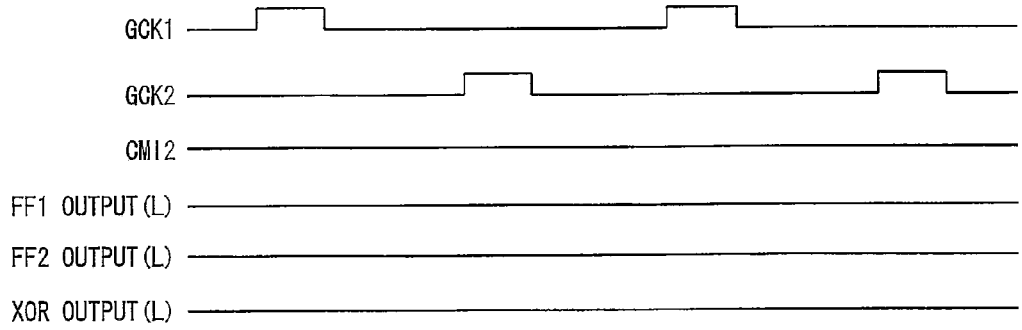

FIG. 10 is a timing chart illustrating how the inversion determining circuit operates during the frame inversion driving.

Figure 11:
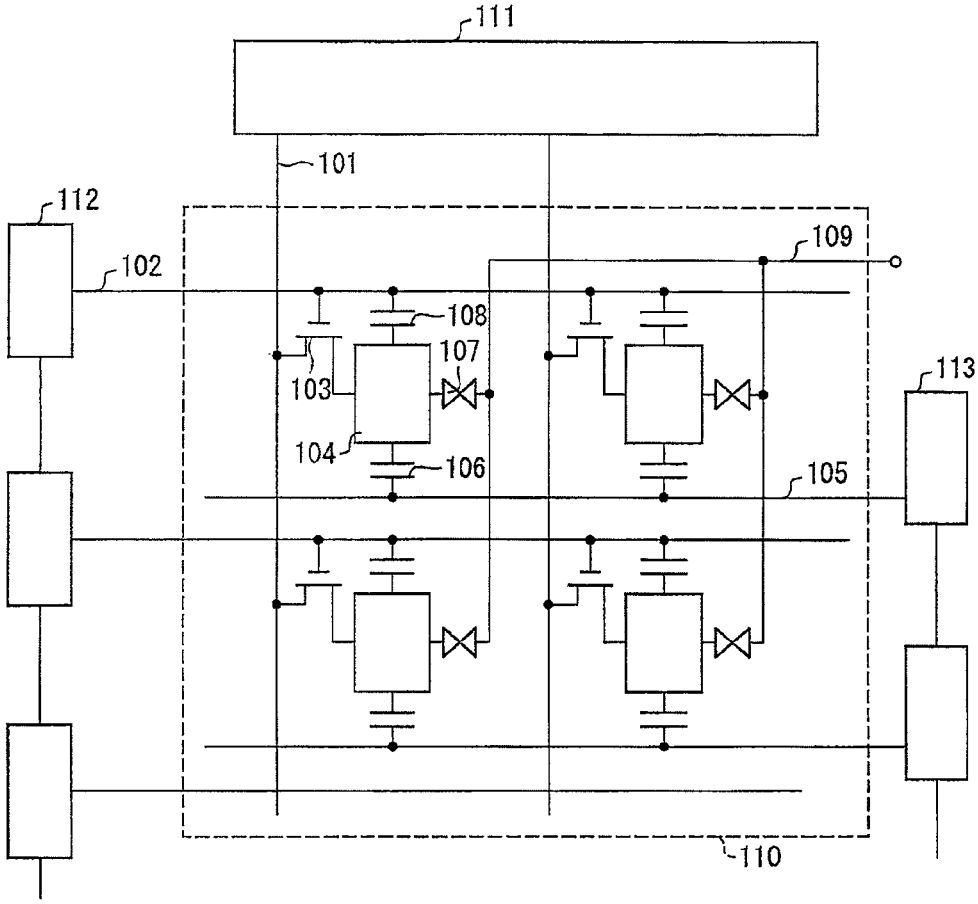
CONVENTIONAL ART FIG. 11

FIG. 11 is a block diagram illustrating a configuration of a conventional liquid crystal display device which carries out CC driving.

Figure 12:
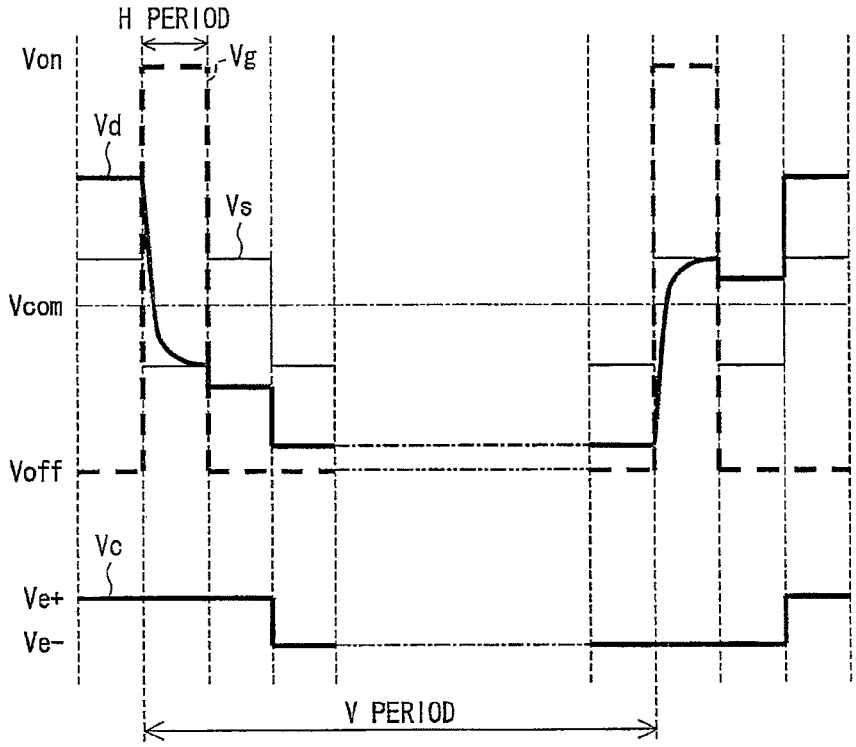
FIG. 12 CONVENTIONAL ART

FIG. 12 is a timing chart illustrating respective waveforms of various signals involved in the conventional liquid crystal display device.

Figure 13:
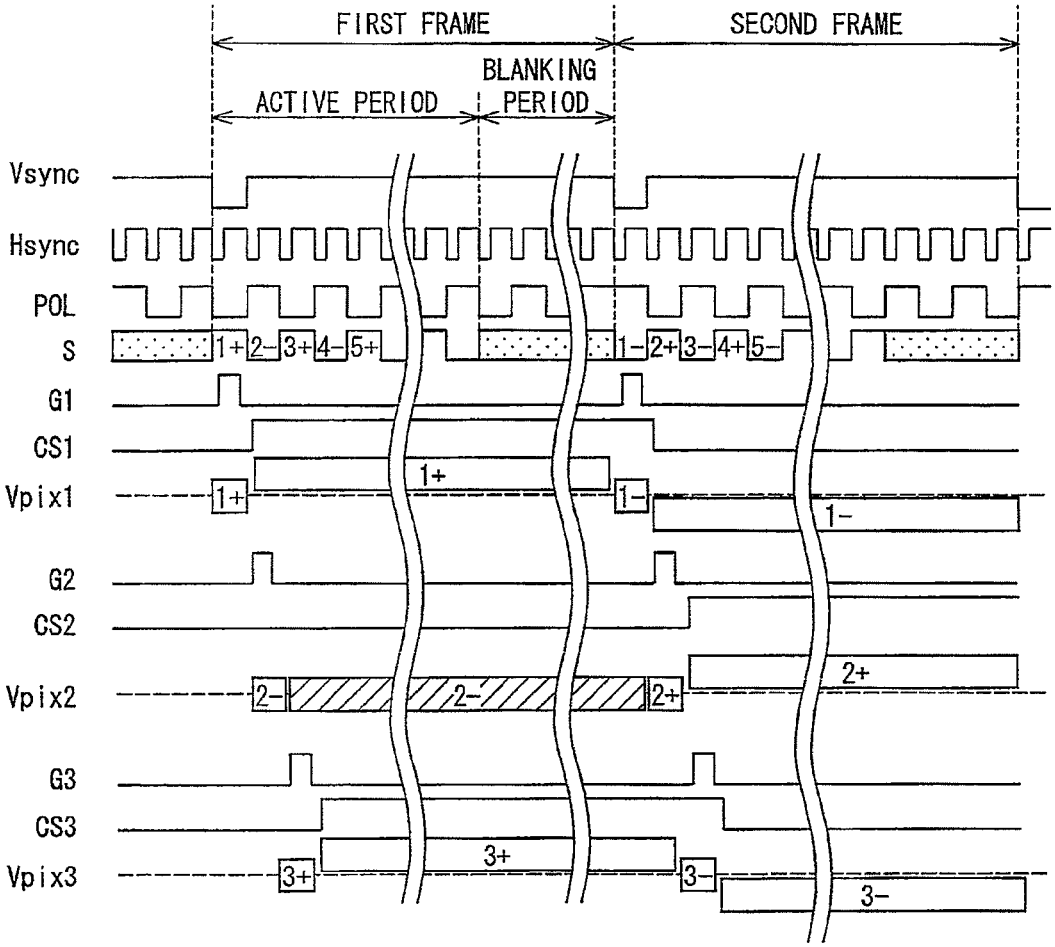
FIG. 13 CONVENTIONAL ART

FIG. 13 is a timing chart illustrating an example which compares the respective waveforms of various signals involved in the conventional liquid crystal display device.

DESCRIPTION OF EMBODIMENTS

An embodiment of the present invention is described below with reference to FIGS. 1 through 10.

Figure 1:
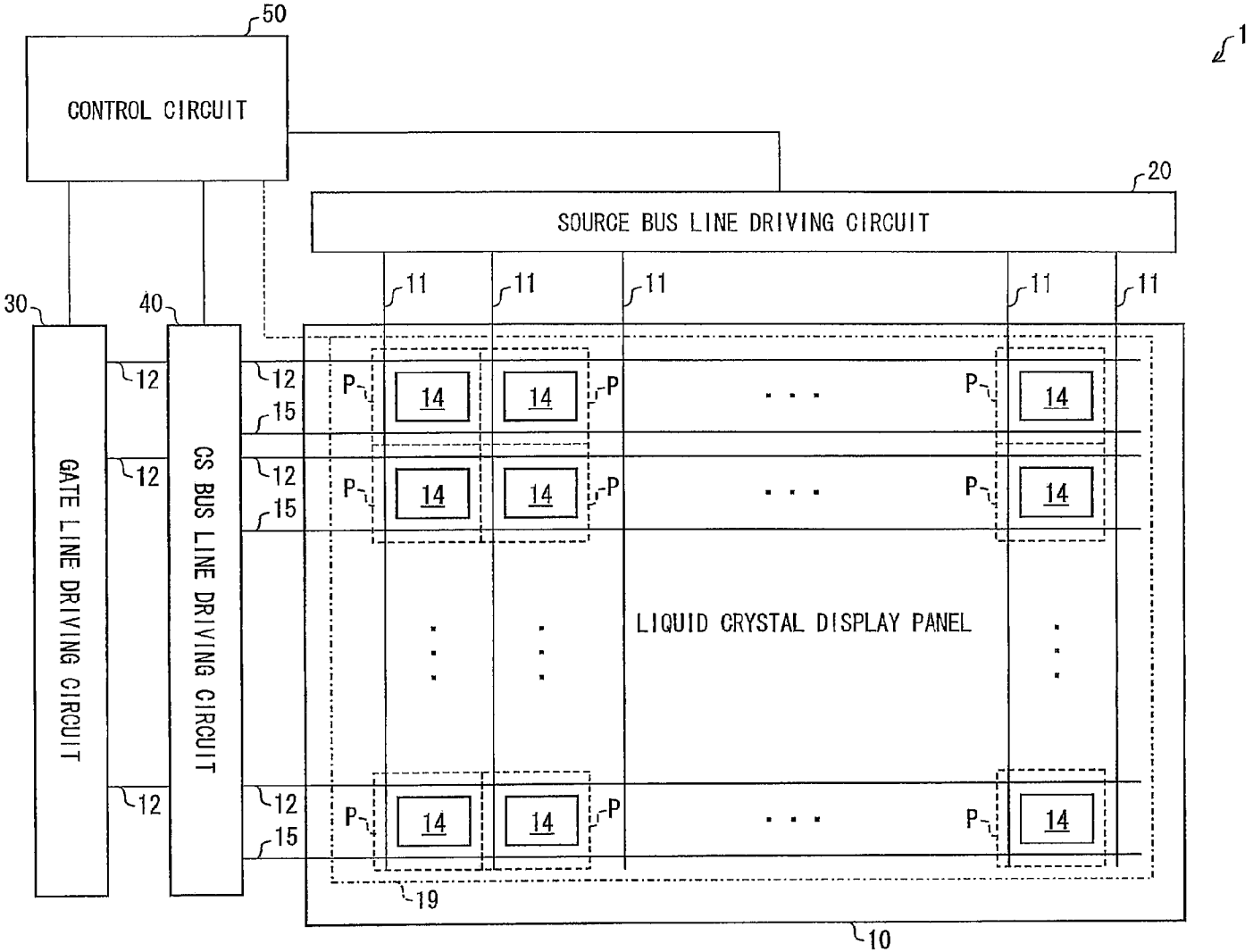
FIG. 1 is a block diagram and illustrating a configuration of a liquid crystal display device in accordance with an embodiment of the present invention.
Figure 2:
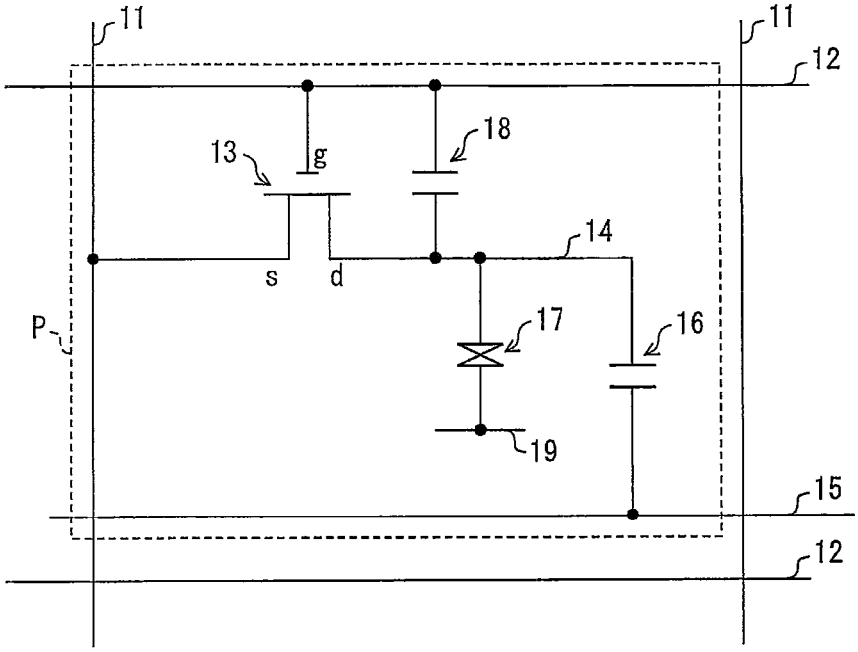
FIG. 2 is an equivalent circuit diagram illustrating an electrical arrangement of each pixel of the liquid crystal display device.

With reference to FIGS. 1 and 2, the following description first deals with a configuration of a liquid crystal display device 1, which corresponds to a display device of the present invention. FIG. 1 is a block diagram illustrating an entire configuration of the liquid crystal display device 1. FIG. 2 is an equivalent circuit diagram illustrating an electrical arrangement of a pixel of the liquid crystal display device 1.

The liquid crystal display device 1 includes: an active matrix liquid crystal display panel 10; a source bus line driving circuit 20; a gate line driving circuit 30; a CS bus line driving circuit 40; and a control circuit 50.

The liquid crystal display panel 10 includes: an active matrix substrate (not shown); a counter substrate (not shown); and liquid crystal (not shown) sandwiched between the active matrix substrate and the counter substrate. The liquid crystal display panel 10 also includes a large number of pixels P arranged in a matrix pattern. The active matrix substrate has provided thereon: source bus lines 11; gate lines 12; thin film transistors (TFTs) 13; pixel electrodes 14; and CS bus lines 15. The counter substrate has provided thereon a counter electrode 19.

The TFTs 13 are omitted in FIG. 1, whereas one of the TFTs 13 is shown in FIG. 2.

The source bus lines 11 are provided so as to extend in parallel to one another in a column direction (longitudinal direction). The source bus lines 11 are each provided for a single column. The gate lines 12 are provided so as to extend in parallel to one another in a row direction (lateral direction). The gate lines 12 are each provided for a single row. The TFTs 13 are provided for respective intersections of the source bus lines 11 with the gate lines 12. The pixel electrodes 14 are provided also for the respective intersections. The TFTs 13 each have (i) a source electrode s connected to a corresponding source bus line 11, (ii) a gate electrode g connected to a corresponding gate line 12, and (iii) a drain electrode d connected to a corresponding pixel electrode 14. The pixel electrodes 14 each define a liquid crystal capacitor 17 between the counter electrode 19 and itself via liquid crystal.

With this configuration, in a case where (i) the gate of the TFT 13 is turned on by a gate signal (scanning signal) supplied to the gate line 12, and (ii) a source signal (data signal) from the source bus line 11 is written to the pixel electrode 14, a potential corresponding to the source signal is supplied to the pixel electrode 14. Consequently, a voltage corresponding to the source signal is applied to liquid crystal present between the pixel electrode 14 and the counter electrode 19. As a result, it is possible to carry out a gradation display in accordance with the source signal.

The CS bus lines 15 are provided so as to extend in parallel to one another in the row direction (lateral direction). The CS bus lines 15 are each provided for a single row. The CS bus lines 15 each form a pair with one of the gate lines 12. Each of the CS bus lines 15 forms a storage capacitor 16 (also referred to as "auxiliary capacitor") between each pixel electrode 14 on the row and itself, and is thus capacitively coupled to such pixel electrodes 14.

The TFTs 13 each have a configuration which causes a feed-through capacitor 18 to be formed between the gate electrode g and the drain electrode d. Thus, a corresponding pixel electrode 14 has a potential which is subject to an influence (feed-through phenomenon) of a change in potential of a corresponding gate line 12. This influence is, however, not taken into consideration herein for simplification of the description.

The liquid crystal display panel 10 configured as above is driven by the source bus line driving circuit 20, the gate line driving circuit 30, and the CS bus line driving circuit 40, all of which receive, from the control circuit 50, various signals necessary to drive the liquid crystal display panel 10.

In the present embodiment, a horizontal scanning period is sequentially allocated to each row during an active period (effective scanning period) within a periodically repeated vertical scanning period so that the rows are sequentially scanned. The gate line driving circuit 30 thus sequentially supplies a gate signal, intended to turn on TFTs 13, to each of the gate lines 12 in sync with a horizontal scanning period for the row.

The source bus line driving circuit 20 supplies source signals to the source bus lines 11. The source signals are generated by the source bus line driving circuit 20, which (i) receives video signals supplied from the outside of the liquid crystal display device 1 via the control circuit 50, and then (ii) allocates the video signals to the individual columns and causes the video signals to be subjected to treatments such as boosting.

Figure 3:
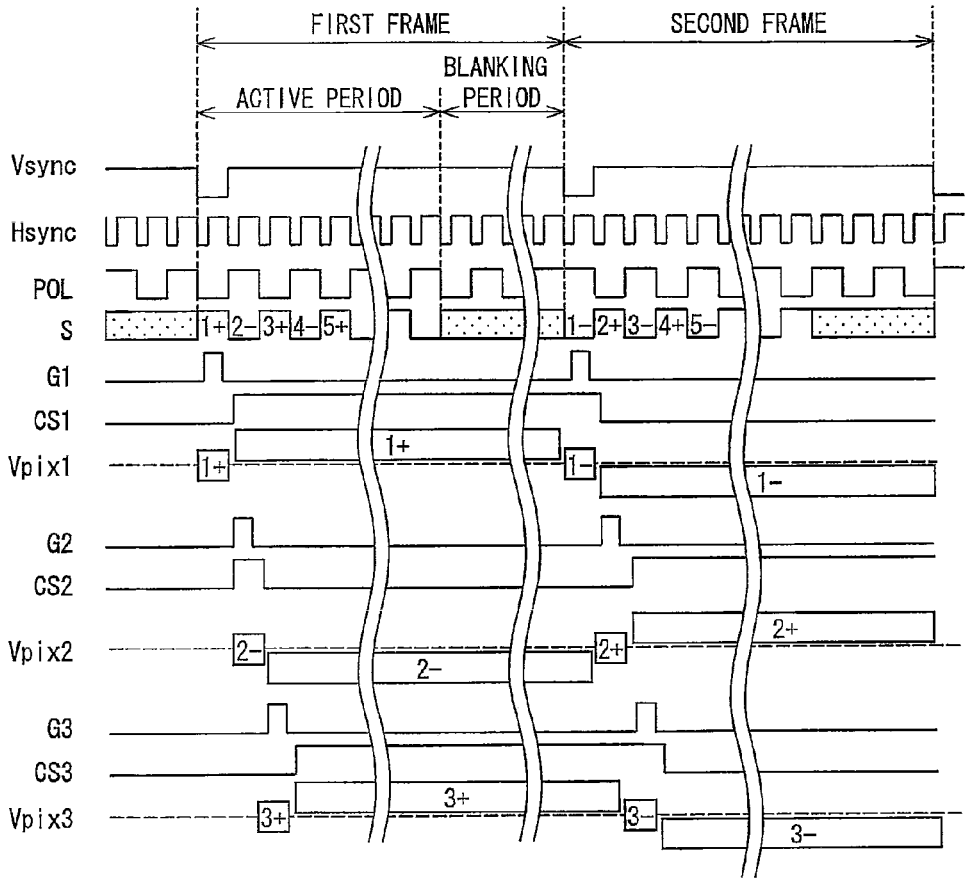
FIG. 3 is a timing chart indicative of an operation of the liquid crystal display device.

The source bus line driving circuit 20 carries out so-called line inversion driving by supplying a source signal which has a polarity that is (i) reversed in sync with the vertical scanning period, (ii) identical for all pixels on each row, and (iii) reversed between adjacent rows. For example, FIG. 3 illustrates a source signal S which has a polarity that is reversed between a horizontal scanning period for a first row and a horizontal scanning period for a second row. In addition, the polarity of the source signal S is also reversed between (i) the horizontal scanning period for the first row in a first frame and (ii) a horizontal scanning period for a first row in a second frame.

The source bus line driving circuit 20 carries out not only the line inversion driving but also so-called frame inversion driving by supplying a source signal which has a polarity that is (i) reversed in sync with the vertical scanning period and (ii) identical for all pixels for an identical frame. The source bus line driving circuit 20 switches its driving method between the line inversion driving and the frame inversion driving so as to, for example, prevent an influence of the liquid crystal display device 1 on other components of an apparatus in which the liquid crystal display device 1 is incorporated. For example, in a case where the liquid crystal display device 1 is included in a mobile telephone as its display device, the driving method is set to the frame inversion during a conversation so as to reduce noise, because line inversion tends to cause large noise (vibration), whereas frame inversion causes only small noise.

The CS bus line driving circuit 40 supplies CS signals to the CS bus lines 15. The CS signals are each a signal which has a potential that is switched between two values (that is, a signal which rises and falls). The CS bus line driving circuit 40 is controlled so that the CS signals each have a potential when TFTs 13 on a corresponding row become turned off (that is, when a corresponding gate signal falls) which potential is different from a potential of a CS signal on a row adjacent to the above row. The CS bus line driving circuit 40 will be described later in further detail.

The control circuit 50 controls the gate line driving circuit 30, the source bus line driving circuit 20, and the CS bus line driving circuit 40 so that these circuits output signals as illustrated in FIG. 3.

What is particularly remarkable about the present embodiment is a feature of the CS bus line driving circuit 40 out of the above members of the liquid crystal display device 1. The following description deals in detail with the CS bus line driving circuit 40.

FIG. 3 is a timing chart illustrating respective waveforms of various signals involved in an operation of the liquid crystal display device 1 of Embodiment 1. FIG. 3 illustrates, as in the example above illustrated in FIG. 13, (i) a vertical synchronizing signal Vsync which defines timing of vertical scanning and (ii) a horizontal synchronizing signal Hsync which defines timing of horizontal scanning. The vertical synchronizing signal Vsync falls a period after its immediately previous fall. This period is defined as one vertical scanning period (1V period). The horizontal synchronizing signal Hsync falls a period after its immediately previous fall. This period is defined as one horizontal scanning period (1H period). FIG. 3 further illustrates a polarity signal POL, which is a signal having a polarity that is reversed in sync with the horizontal scanning period.

FIG. 3 further illustrates, in an order presented below, a source signal S, a gate signal G1, a CS signal CS1, and a potential waveform Pix1 of a pixel electrode 14 provided at an intersection of the first row with an x-th column. The source signal S is supplied from the source bus line driving circuit 20 to a source bus line 11 (that is, a source bus line 11 on the x-th column). The gate signal G1 is supplied from the gate line driving circuit 30 to a gate line 12 on the first row. The CS signal CS1 is supplied from the CS bus line driving circuit 40 to a CS bus line 15 on the first row. FIG. 3 also illustrates, in an order presented below, (i) a gate signal G2 supplied to a gate line 12 on a second row, a CS signal CS2 supplied to a CS bus line 15 on the second row, and (iii) a potential waveform Pix2 of a pixel electrode 14 provided at an intersection of the second row with the x-th column. FIG. 3 still further illustrates, in an order presented below, (i) a gate signal G3 supplied to a gate line 12 on a third row, a CS signal CS3 supplied to a CS bus line 15 on the third row, and (iii) a potential waveform Pix3 of a pixel electrode 14 provided at an intersection of the third row with the x-th column.

FIG. 3 shows a broken line for each of the potentials Vpix1, Vpix2, and Vpix3 to represent a potential of the counter electrode 19.

The liquid crystal display device 1 starts operating when, for example, supplied with power, and then displays a first frame (that is, a start frame) of a display (hereinafter referred to as "video image display") corresponding to a video image to be displayed. Immediately before displaying the first frame, however, the liquid crystal display device 1 is in an initial state in which it carries out no video image display (see FIG. 3).

When the liquid crystal display device 1 of the present embodiment is in the initial state, each of the CS signals CS1, CS2, and CS3 is, as illustrated in FIG. 3, constantly set at one potential (low level in FIG. 3) as in the case illustrated in FIG. 13. The CS signal CS2 out of the three signals is switched from a low level to a high level in sync with a rise of the corresponding gate signal G2, so that the CS signal CS2 is at the high level when the gate signal G2 falls. As such, the CS signals each have a potential at the fall of a corresponding gate signal on the row which potential is different from a potential of a CS signal on a row adjacent to the above row. For example, the CS signal CS1 is at the low level when its corresponding gate signal G1 falls, the CS signal CS2 is at the high level as described above when its corresponding gate signal G2 falls, and the CS signal CS3 is at the low level when its corresponding gate signal G3 falls.

The source signal S has an amplitude corresponding to a tone level represented by a video signal, and reverses its polarity every 1H period. In FIG. 3, which assumes a display of a uniform video image, the source signal S has a constant amplitude. The gate signals G1, G2, and G3 are each at a gate-on potential during first, second, and third 1H periods, respectively, within the active period (effective scanning period) of each frame. The gate signals G1, G2, and G3 are each at a gate-off potential during the other period.

The CS signals CS1, CS2, and CS3 each reverse its polarity after a corresponding one of the gate signals G1, G2, and G3 falls. The CS signals CS1, CS2, and CS3 also show their respective waveforms having opposite reversal directions. Specifically, during each odd-numbered frame (first frame, third frame, etc.), the CS signals CS1 and CS3 each rise after the fall of a corresponding one of the gate signals G1 and G3, whereas the CS signal CS2 rises after the fall of its corresponding gate signal G2. During each even-numbered frame (second frame, fourth frame, etc.), the CS signals CS1 and CS3 each fall after the fall of a corresponding one of the gate signals G1 and G3, whereas the CS signal CS2 rises after the fall of its corresponding gate signal G2.

Note that the rise and fall of the CS signals CS1, CS2, and CS3 are reversible between odd-numbered frames and even-numbered frames.

In FIG. 3, the CS signals in the first frame each have a potential at the fall of a corresponding gate signal which potential is different from a potential of a CS signal on an adjacent row. The CS signals CS1, CS2, and CS3 in the first frame thus have the same waveforms as those of a normal odd-numbered frame (for example, the third frame). As such, the respective potentials Vpix1, Vpix2, and Vpix3 of the three pixel electrodes 14 are properly shifted by the CS signals CS1, CS2, and CS3, respectively. As such, in a case where source signals S having an identical tone level are inputted, a potential difference between (i) the potential of the counter electrode and (ii) the potential of any pixel electrode 14 after the shift is identical in positive and negative polarities. As a result, it is possible to (i) eliminate an appearance of lateral stripes in the first frame and thus (ii) improve display quality.

The CS bus line driving circuit 40, as described above, causes the CS signal CS2 in the first frame to switch from the low level to the high level in sync with a rise of the corresponding gate signal G2. The CS bus line driving circuit 40 causes a CS signal on every other row (CS2, CS4, etc.) to switch from the low level to the high level in sync with a rise of a corresponding gate signal in the manner described above. With this arrangement, the CS signals each have a potential at the fall of a corresponding gate signal which potential is different from a potential of a CS signal on an adjacent row.

Figure 4:
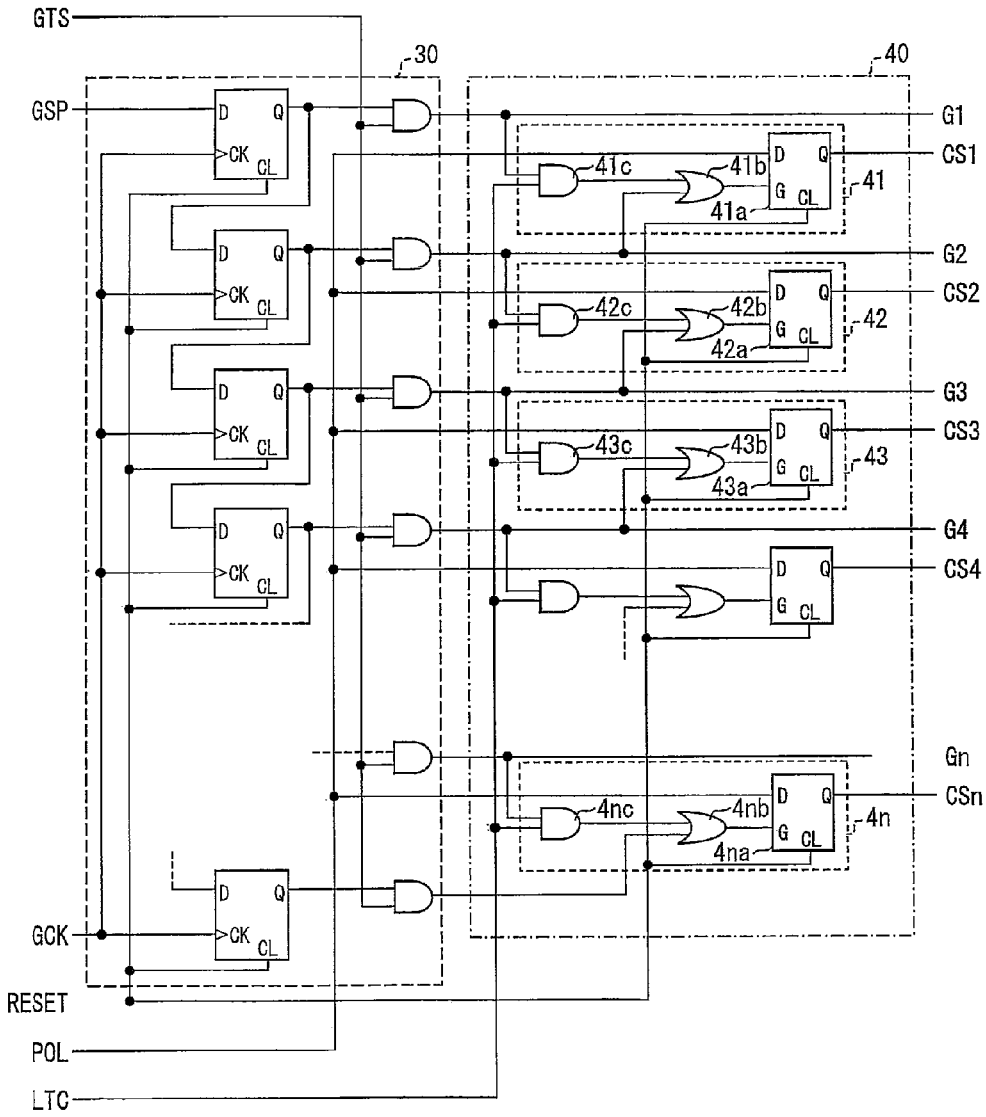
FIG. 4 is a circuit diagram illustrating a configuration of a CS bus line driving circuit of the liquid crystal display device.

The following description deals with a detailed configuration of the CS bus line driving circuit 40, which carries out the above control. FIG. 4 illustrates the configuration of the CS bus line driving circuit 40.

As illustrated in FIG. 4, the CS bus line driving circuit 40 includes a plurality of logic circuits 41, 42, 43 . . . , and 4*n* on the respective rows. The logic circuits 41, 42, 43 . . . , and 4*n* include: D-latch circuits 41*a*, 42*a*, 43*a* . . . , and 4*na*; OR circuits 41*b*, 42*b*, 43*b* . . . , and 4*nb*; and AND circuits 41*c*, 42*c*, 43*c* . . . , and 4*nc*, respectively. For convenience of explanation, the description below takes, as an example, the logic circuits 41 and 42 provided on the first and second rows, respectively.

The logic circuit 41 receives a gate signal G1, a gate signal G2, a polarity signal POL, a reset signal RESET, and a two-stage gate latch signal LTC. The logic circuit 42 receives the gate signal G2, a gate signal G3, the polarity signal POL, the reset signal RESET, and the two-stage gate latch signal LTC. The polarity signal POL and the reset signal RESET are supplied from the control circuit 50. The two-stage gate latch signal LTC can be supplied from the control circuit 50 or generated inside the CS bus line driving circuit 40.

The D-latch circuit 41*a* receives (i) the reset signal RESET at its reset terminal CL, (ii) the polarity signal POL at its data terminal D (second input section), and (iii) an output from the OR circuit 41*b* at its terminal G (first input section). The D-latch circuit 41*a* outputs a CS signal CS1, indicative of a change in potential level (that is, a low level or a high level) of the polarity signal POL inputted to the data terminal D, in accordance with a change (that is, from a low level to a high level or vice versa) in potential level of the signal inputted to the terminal G. The CS signal CS1 is thus a signal indicative of an input state of the polarity signal POL.

Specifically, the D-latch circuit 41*a* outputs a signal, indicative of an input state (that is, a low level or a high level) of the polarity signal POL inputted to the data terminal D, when the signal inputted to the terminal G has a high potential level. When the potential level of the signal inputted to the terminal G is switched from the high level to the low level, the D-latch circuit 41*a* latches the input state (that is, the low level or the high level) of the polarity signal POL being inputted to the terminal D at the time of the switch, and maintains the latched state until the potential level of the signal inputted to the terminal G is switched back to the high level. The D-latch circuit 41*a* thus outputs, from the output terminal Q, the CS signal CS1 indicative of a change in potential level of the polarity signal POL.

Similarly, the D-latch circuit 42*a* receives the reset signal RESET and the polarity signal POL at its reset terminal CL and its data terminal D, respectively. Further, the D-latch circuit 42*a* receives, at its terminal G, an output from the OR circuit 42*b*. The D-latch circuit 42*a* thus outputs, from its output terminal Q (output section), a CS signal CS2 indicative of a change in potential level of the polarity signal POL.

Figure 5:
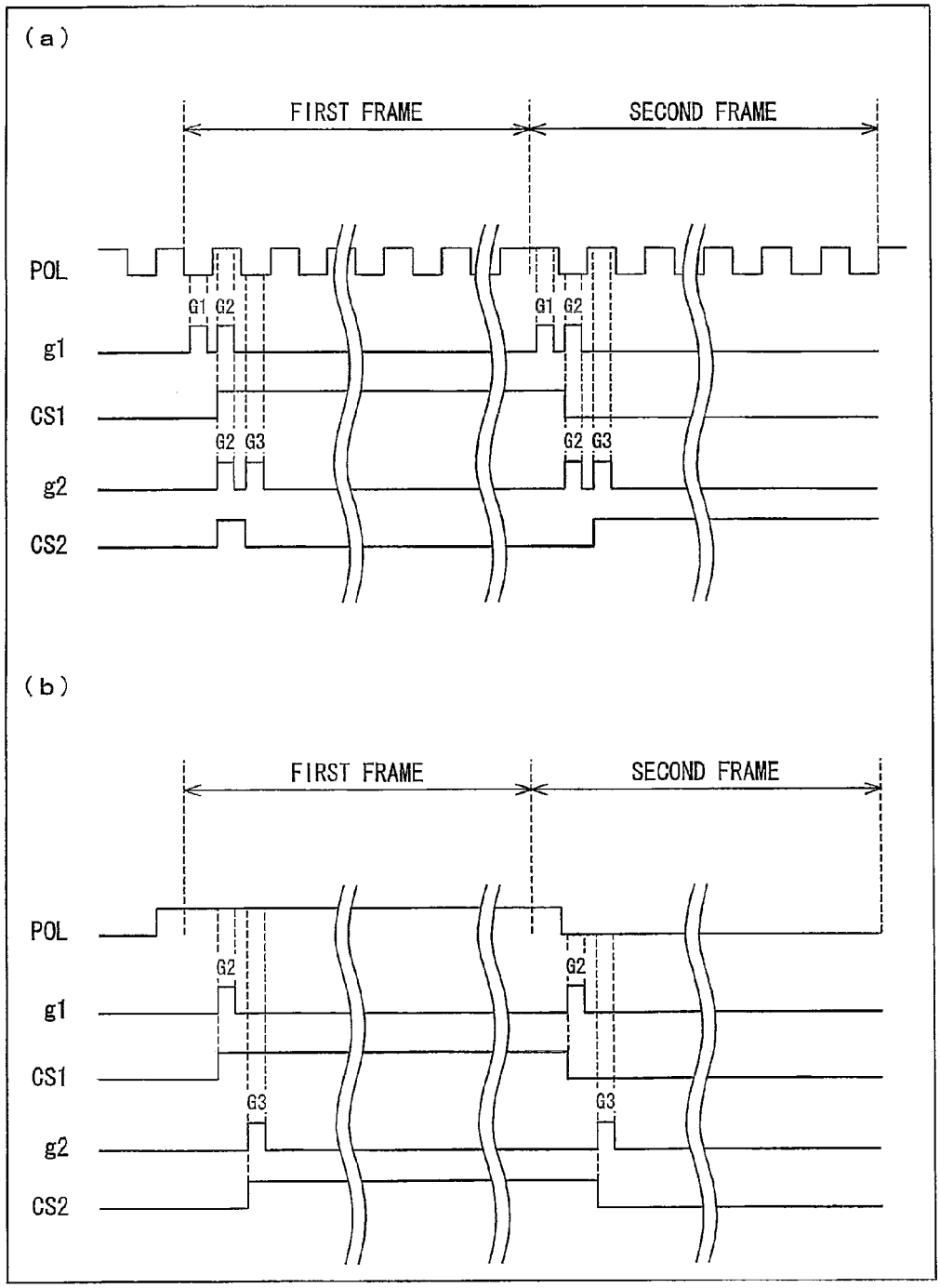
FIG. 5

The OR circuit 41*b* receives (i) the gate signal G1 of a corresponding gate line 12 not via the AND circuit 41*c* and (ii) the gate signal G2 of a gate line 12 on a subsequent row, and consequently outputs a signal g1 illustrated in (a) of FIG. 5. The OR circuit 42*b* receives (i) the gate signal G2 of its corresponding gate line 12 and (ii) the gate signal G3 of a gate line 12 on a subsequent row, and consequently outputs a signal g2 also illustrated in (a) of FIG. 5.

Gate signals inputted to the OR circuits are generated by a known method in the gate line driving circuit 30, illustrated in FIG. 4, which includes D-type flip-flop circuits. The gate line driving circuit 30 sequentially shifts a gate start pulse GSP, supplied from the control circuit 50, from one flip-flop circuit to the next at timing of a gate clock GCK having a cycle of one horizontal scanning period. The gate line driving circuit 30 outputs, from each of its AND circuits, a logical conjunction of (i) a pulse outputted from a corresponding flip-flop circuit and (ii) a gate timing signal GTS so as to generate the gate signals G1, G2, G3 . . . , and Gn.

(a) of FIG. 5 illustrates respective waveforms of various signals inputted to and outputted from the CS bus line driving circuit 40 of the liquid crystal display device 1.

The following description first deals with changes in respective waveforms of various signals on the first row. In an initial state, the D-latch circuit 41*a* of the logic circuit 41 receives a polarity signal POL at its data terminal D and a reset signal RESET at its reset terminal CL. The reset signal RESET causes the D-latch circuit 41*a* to constantly output, from its output terminal Q, a CS signal CS1 having a low potential level.

Next, the gate line driving circuit 30 supplies a gate signal G1 to the gate line 12 on the first row, and the gate signal G1 is inputted to one of input terminals of the OR circuit 41*b* of the logic circuit 41. The D-latch circuit 41*a* thus receives at its terminal G a signal g1 having a potential level which is changed (that is, from a low level to a high level) by the gate signal G1. In response, the D-latch circuit 41*a* outputs a signal (that is, a signal having a low level) indicative of an input state of the polarity signal POL being inputted to the data terminal D at the time of the above change in potential level. The D-latch circuit 41*a* outputs the signal having a low level until the potential level of the signal g1 inputted to the terminal G is next changed (that is, from the high level to the low level) by the gate signal G1 (that is, while the signal g1 is at the high level). When the potential level of the signal g1 inputted to the terminal G is next changed (that is, from the high level to the low level) by the gate signal G1, the D-latch circuit 41*a* latches the input state (that is, the low level state) of the polarity signal POL being inputted at the time of the change. The D-latch circuit 41*a* then maintains the low level state until the signal g1 is switched to the high level.

Then, the OR circuit 41*b* receives at the other of its input terminals a gate signal G2 generated as shifted in the gate line driving circuit 30 on the second row. The gate signal G2 is supplied to the gate line 12 on the second row, and is inputted to one of input terminals of the OR circuit 42*b* of the logic circuit 42 if not via the AND circuit 42*c*.

Next, when the potential level of the signal g1 inputted to the terminal G of the D-latch circuit 41*a* is changed (that is, from the low level to the high level) by the gate signal G2, the D-latch circuit 41*a* outputs a signal (that is, a signal having a high level) indicative of an input state of the polarity signal POL being inputted to the data terminal D after the change. In other words, the potential of the CS signal CS1 is switched from the low level to the high level at the timing of a change in potential level (that is, from the low level to the high level) of the gate signal G2. The D-latch circuit 41*a* outputs the signal having a high level until the potential level of the signal g1 inputted to the terminal G is next changed (that is, from the high level to the low level) by the gate signal G2 (that is, while the signal g1 is at the high level). When the potential level of the signal g1 inputted to the terminal G is next changed (that is, from the high level to the low level) by the gate signal G2, the D-latch circuit 41*a* latches an input state (that is, the high level state) of the polarity signal POL being inputted at the time of the change. The D-latch circuit 41*a* then maintains the high level state until the signal g1 is switched to the high level during a second frame.

During the second frame, the D-latch circuit 41*a* outputs a signal, indicative of the input state (that is, the high level state) of the polarity signal POL inputted to the data terminal D, while the signal g1 is at the high level due to the gate signal G1. Then, when the potential level of the signal g1 is changed (that is, from the high level to the low level) by the gate signal G1, the D-latch circuit 41*a* latches an input state (that is, the high level state) of the polarity signal POL being inputted at the time of the change, and then maintains the low level state until the signal g1 is switched to the high level.

Next, the potential level of the signal g1 inputted to the terminal G of the D-latch circuit 41*a* is changed (that is, from the low level to the high level) by the gate signal G2. In response, the D-latch circuit 41*a* outputs a signal (that is, a signal having a low level) indicative of an input state of the polarity signal POL being inputted to the terminal D at the time of the change. In other words, the potential of the CS signal CS1 is switched from the high level to the low level at the timing of a change in potential level (that is, from the low level to the high level) of the gate signal G2.

The D-latch circuit 41*a* constantly outputs the signal having a low level until the potential level of the signal g1 inputted to the terminal G is next changed (that is, from the high level to the low level) by the gate signal G2 (that is, while the signal g1 is at the high level). When the potential level of the signal g1 inputted to the terminal G is next changed (that is, from the high level to the low level) by the gate signal G2, the D-latch circuit 41*a* latches an input state (that is, the low level state) of the polarity signal POL being inputted at the time of the change. The D-latch circuit 41*a* then maintains the low level state until the signal g1 is switched to the high level during a third frame. Through the third frame and its subsequent frames, the respective processes for the first frame and the second frame are alternately repeated.

The following description next deals with changes in respective waveforms of various signals on the second row.

In an initial state, the D-latch circuit 42*a* of the logic circuit 42 receives a polarity signal POL at its terminal D and a reset terminal CL at its reset signal RESET. The reset signal RESET causes the D-latch circuit 42*a* to constantly output, from its output terminal Q, a CS signal CS2 having a low potential level.

Next, as described above, the gate line driving circuit 30 supplies a gate signal G2 to the gate line 12 on the second row, and the gate signal G2 is inputted to one of input terminals of the OR circuit 42*b* of the logic circuit 42. The D-latch circuit 42*a* thus receives at its terminal G a signal g2 having a potential level which is changed (that is, from a low level to a high level) by the gate signal G2. In response, the D-latch circuit 42*a* outputs a signal (that is, a signal having a high level) indicative of an input state of the polarity signal POL being inputted to the terminal D at the time of the above change in potential level. In other words, the potential of the CS signal CS2 is switched from the low level to a high level at the timing of a change in potential level (that is, from the low level to the high level) of the gate signal G2. The D-latch circuit 42*a* outputs the signal having a high level until the potential level of the signal g2 inputted to the terminal G is next changed (that is, from the high level to the low level) by the gate signal G2 (that is, while the signal g2 is at the high level).

When the potential level of the signal g2 inputted to the terminal G is next changed (that is, from the high level to the low level) by the gate signal G2, the D-latch circuit 42*a* latches the input state (that is, the high level state) of the polarity signal POL being inputted to the terminal D at the time of the change. The D-latch circuit 41*a* then maintains the high level state until the signal g2 is switched to the high level.

Then, the OR circuit 42*b* receives at the other of its input terminals a gate signal G3 generated as shifted in the gate line driving circuit 30 on the third row. The gate signal G3 is supplied to the gate line 12 on the third row, and is inputted to one of input terminals of the OR circuit 43*b* of the logic circuit 43 if not via the AND circuit 43*c*.

Next, when the potential level of the signal g2 inputted to the terminal G of the D-latch circuit 42*a* is changed (that is, from the low level to the high level) by the gate signal G3, the D-latch circuit 42*a* outputs a signal (that is, a signal having a low level) indicative of an input state of the polarity signal POL being inputted to the data terminal D at the time of the change. In other words, the potential of the CS signal CS2 is switched from the high level to the low level at the timing of a change in potential level (that is, from the low level to the high level) of the gate signal G3. The D-latch circuit 42*a* outputs the signal having a low level until the potential level of the signal g2 inputted to the terminal G is next changed (that is, from the high level to the low level) by the gate signal G3 (that is, while the signal g2 is at the high level). When the potential level of the signal g2 inputted to the terminal G is next changed (that is, from the high level to the low level) by the gate signal G3, the D-latch circuit 42*a* latches an input state (that is, the low level state) of the polarity signal POL being inputted to the terminal D at the time of the change. The D-latch circuit 42*a* then maintains the high level state until the signal g1 is switched to the high level during the second frame.

During the second frame, the D-latch circuit 41*a* outputs a signal, indicative of the input state (that is, the low level state) of the polarity signal POL inputted to the data terminal D, while the signal g2 is at the high level due to the gate signal G2. Then, when the potential level of the signal g2 is changed (that is, from the high level to the low level) by the gate signal G2, the D-latch circuit 41*a* latches an input state (the low level state) of the polarity signal POL being inputted at the time of the change, and then maintains the low level state until the signal g2 is switched to the high level.

Next, when the potential level of the signal g2 inputted to the terminal G of the D-latch circuit 42*a* is changed (that is, from the low level to the high level) by the gate signal G3, the D-latch circuit 42*a* outputs a signal (that is, a signal having a high level) indicative of an input state of the polarity signal POL being inputted to the terminal D at the time of the change. In other words, the potential of the CS signal CS2 is switched from the low level to the high level at the timing of a change in potential level (that is, from the low level to the high level) of the gate signal G3. The D-latch circuit 42*a* outputs the signal having a high level until the potential level of the signal g2 inputted to the terminal G is next changed (that is, from the high level to the low level) by the gate signal G3 (that is, while the signal g2 is at the high level). When the potential level of the signal g2 inputted to the terminal G is next changed (that is, from the high level to the low level) by the gate signal G2, the D-latch circuit 41*a* latches an input state (that is, the high level state) of the polarity signal POL being inputted at the time of the change. The D-latch circuit 42*a* then maintains the high level state until the signal g1 is switched to the high level during a third frame.

The operation for the second row during the second frame is identical to that for the first row during the first frame. Through the third frame and its subsequent frames, the respective processes for the first row during the second frame and the third frame are alternately repeated on the second row. The above operation for the first row indicates an operation for any odd-numbered row, whereas the above operation for the second row indicates an operation for any even-numbered row.

With the above use of the logic circuits 41, 42, 43 . . . , and 4*n* provided on the respective rows, the CS signals are each outputted for each frame so that the CS signal has a potential when a gate signal on a corresponding row falls (that is, when TFTs 13 on the row are turned off) which potential is different from a potential of a CS signal on a row adjacent to the above row. More specifically, according to the present embodiment, a CS signal supplied to a CS bus line 15 on an n-th row is generated by latching (i) a potential level of the polarity signal POL at the rise of a gate signal Gn on the n-th row and (ii) a potential level of the polarity signal POL at the rise of a gate signal G(n+1) on an (n+1)th row. With the arrangement, it is possible to (i) properly operate the CS bus line driving circuit during the first frame, and thus (ii) eliminate the above-mentioned irregular waveforms which cause the lateral stripes during the first frame. It follows that it is possible to (i) prevent the appearance of such lateral stripes during the first frame, and thus (ii) improve display quality.

Note that the CS bus line driving circuit 40 of Embodiment 1 can be incorporated in a conventional gate line driving circuit 30 or provided outside the conventional gate line driving circuit 30 so as to be connected thereto.

The following description next deals with (i) how the AND circuits 41*c*, 42*c*, 43*c* . . . , and 4*nc* are provided and operated in the CS bus line driving circuit 40.

The AND circuits 41*c*, 42*c*, 43*c* . . . , and 4*nc* each receive (i) a corresponding one of the gate signals G1, G2, and G3 . . . , and Gn and (ii) a common two-stage latch gate signal LTC, and each output a logical product of the two signals received. The AND circuits 41*c*, 42*c*, 43*c* . . . , and 4*nc* each output the signal to one of input terminals of a corresponding one of the OR circuits 41*b*, 42*b*, 43*b* . . . , and 4*nb*.

The two-stage latch gate signal LTC is an inversion determining signal RDS shown in FIG. 6.

FIG. 6 illustrates a configuration of an inversion determining circuit 60 for generating the inversion determining signal RDS.

The inversion determining circuit 60 determines whether the source bus line driving circuit 20 is carrying out the line inversion driving or the frame inversion driving. To perform the determination, the inversion determining circuit 60 includes D-type flip-flop circuits FF1 through FF3 and an exclusive OR circuit XOR as illustrated in FIG. 6.

The flip-flop circuit FF1 receives a frequency divided gate clock GCK1 at its clock terminal CK. The flip-flop FF2 receives a frequency divided gate clock GCK2 at its clock terminal CK. Further, the flip-flop circuits FF1 and FF2 each receive a reset signal RESET at its reset terminal CL and a CS level inversion signal CMI at its data terminal D. The flip-flop circuits FF1 and FF2 each output a signal from its output terminal Q to the exclusive OR circuit XOR.

The flip-flop circuit FF3 receives, (i) at its data terminal D, a signal outputted from the exclusive OR circuit XOR, and (ii) at its reset terminal CL, a reset signal RESET. Further, the flip-flop circuit FF3 receives the above-mentioned gate start pulse GSP at its clock terminal CK.

As illustrated in FIGS. 7 and 8, the frequency divided gate clocks GCK1 and GCK2 are each obtained by dividing a frequency of the above-mentioned gate clock by two. The frequency divided gate clocks GCK1 and GCK2 are shifted in phase relative to each other by half a cycle.

The CS level inversion signal CMI is a control signal for reversing a level of each CS signal CS, and is generated by the control circuit 50. The CS level inversion signal CMI is identical to the polarity signal POL, and has a first cycle for the line inversion driving and a second cycle for the frame inversion driving, the first cycle being different from the second cycle. Specifically, in a case of the line inversion driving illustrated in FIG. 7, the CS level inversion signal CMI is a CS level inversion signal CMI1 having a level reversed every 1H, whereas in a case of the frame inversion driving illustrated in FIG. 8, the CS level inversion signal CMI is a CS level inversion signal CMI2 having a level reversed every 1V.

The following description deals with an operation of the inversion determining circuit 60 configured as above. FIG. 9 illustrates an operation of the inversion determining circuit 60 for the line inversion driving. FIG. 10 illustrates an operation of the inversion determining circuit 60 for the frame inversion driving.

First, as illustrated in FIG. 9, the flip-flop circuits FF1 and FF2 each receive the CS level inversion signal CMI1 as the CS level inversion signal CMI in the case where the source bus line driving circuit 20 is carrying out the line inversion driving. In this state, the flip-flop circuit FF1 maintains the CS level inversion signal CMI1 at a high level ("H") at a rise of the frequency divided gate clock GCK1, and outputs the CS level inversion signal CMI1. Further, in the above state, the flip-flop circuit FF2 maintains the CS level inversion signal CMI1 at a low level ("L") at a rise of the frequency divided gate clock GCK2, and outputs the CS level inversion signal CMI1. The exclusive OR circuit XOR, since the two signals inputted are at different levels, outputs a signal having a high level ("H"). As such, the flip-flop circuit FF3 maintains a signal having a high level ("H") at a rise of the gate start pulse GSP, and outputs the high-level signal as the inversion determining signal RDS.

Then, as illustrated in FIG. 10, the flip-flop circuits FF1 and FF2 each receive the CS level inversion signal CMI2 as the CS level inversion signal CMI in the case where the source bus line driving circuit 20 is carrying out the frame inversion driving. In this state, the flip-flop circuit FF1 maintains the CS level inversion signal CMI1 at a low level ("L") at the rise of the frequency divided gate clock GCK1, and outputs the CS level inversion signal CMI1. Further, in the above state, the flip-flop circuit FF2 maintains the CS level inversion signal CMI1 at a low level ("L") at the rise of the frequency divided gate clock GCK2, and outputs the CS level inversion signal CMI1. The exclusive OR circuit XOR, since the two signals inputted are at an identical level, outputs a signal having a low level ("L"). As such, the flip-flop circuit FF3 maintains a signal having a low level ("L") at the rise of the gate start pulse GSP, and outputs the low-level signal as the inversion determining signal RDS.

As described above, the inversion determining circuit 60 outputs (i) a high-level inversion determining signal RDS in the case where the line inversion driving is being carried out, and (ii) a low-level inversion determining signal RDS in the case where the frame inversion driving is being carried out.

The following description deals with an operation of the CS bus line driving circuit 40 in which the inversion determining signal RDS is used as the above-mentioned two-stage latch gate signal LTC.

As described above, in the case where the line inversion driving is being carried out, a high-level two-stage latch gate signal LTC is inputted to each of the AND circuits 41*c*, 42*c*, 43*c* . . . , and 4*nc*. As such, the gate signals G1, G2, and G3 . . . , and Gn are inputted to the OR circuits 41*b*, 42*b*, 43*b*, . . . 4*nb* via the AND circuits 41*c*, 42*c*, 43*c* . . . , and 4*nc* in the logic circuits 41, 42, 43 . . . , and 4*n*, respectively. This causes the CS bus line driving circuit 40 to operate as above in the case where the line inversion driving is being carried out.

On the other hand, in the case where the frame inversion driving is being carried out, a low-level two-stage latch gate signal LTC is inputted to each of the AND circuits 41*c*, 42*c*, 43*c* . . . , and 4*nc*. As such, the gate signals G1, G2, and G3 . . . , and Gn are not inputted to the OR circuits 41*b*, 42*b*, 43*b*, . . . 4*nb* via the AND circuits 41*c*, 42*c*, 43*c* . . . , and 4*nc* in the logic circuits 41, 42, 43 . . . , and 4*n*, respectively. This causes each of the OR circuits 41*b*, 42*b*, 43*b*, . . . 4*nb* to output a signal on a subsequent row, namely the gate signals G2, G3, G4 . . . , and Gn+1, respectively.

With the above arrangement, the frame inversion driving is different from the line inversion driving in that in the frame inversion driving, only the gate signal G2 is outputted as the signal g1, and only the gate signal G3 is outputted as the signal g2 as illustrated in (b) of FIG. 5. In the case where the frame inversion driving is being carried out, the polarity signal POL is not alternated line by line, and thus has a polarity which does not vary within one frame period. Thus, even in a case where the potential level of the polarity signal POL is, as in the line inversion driving, latched with use of the signals g1, g2, . . . each having two consecutive pulses, the CS signals CS1, CS2, . . . are each merely slightly led in phase by a first pulse, and thus remain substantially identical.

As described above, according to the liquid crystal display device 1 of the present embodiment, the display driving circuit causes (i) the gate line driving circuit 30 to output a gate signal for turning on TFTs 13 on each row for a corresponding one of the horizontal scanning periods which are sequentially allocated to the respective rows, (ii) the source bus line driving circuit 20 to output a source signal having a polarity that is reversed in sync with the horizontal scanning period for each row and that is reversed between consecutive horizontal scanning periods for an identical row, and (iii) the CS bus line driving circuit 40 to output a CS signal having a potential which is, after the horizontal scanning period for the row, switched between two values in a direction determined in accordance with the polarity of a source signal for the horizontal scanning period. The potential of the CS signal outputted by the CS bus line driving circuit 40 is different between adjacent rows at the time at which the TFTs 13 on the row are turned off (that is, at the time of gate-off).

With the arrangement, it is possible to (i) properly shift the potential of each pixel electrode 14 with use of CS signals during the first frame, and (ii) eliminate the appearance of lateral stripes during the first frame. As a result, it is possible to improve display quality of the liquid crystal display device 1.

Further, the liquid crystal display device 1 of the present embodiment discriminates between the line inversion driving and the frame inversion driving, and thus causes the CS bus line driving circuit 40 to operate differently for the line inversion driving and for the frame inversion driving. With the arrangement, the liquid crystal display device 1 (i) prevents a display defect such as the appearance of the lateral stripe during the line inversion driving, and (ii) does not carry out, during the frame inversion driving, the preventive operation carried out during the line inversion driving.

The present invention is not limited to the description of the embodiments above, but may be altered in various ways by a skilled person within the scope of the claims. Any embodiment based on a proper combination of technical means disclosed in different embodiments is also encompassed in the technical scope of the present invention.

INDUSTRIAL APPLICABILITY

The present invention is particularly suitably applicable to display driving for an active matrix liquid crystal display device driven by CC driving method.

REFERENCE SIGNS LIST

1 liquid crystal display device (display device)
10 liquid crystal display panel (display panel)
11 source bus line (data signal line)
12 gate line (scanning signal line)
13 TFT (switching element)
14 pixel electrode
15 CS bus line (capacity coupling line)
20 source bus line driving circuit (data signal line driving circuit)
30 gate line driving circuit (scanning signal line driving circuit)
40 CS bus line driving circuit (capacity coupling line driving circuit)
41*a*, 42*a*, 43*a*, 4*na* D-latch circuit (capacity coupling line driving circuit)
50 control circuit (control circuit)

The invention claimed is:

1. A display driving circuit for driving a display panel,
the display panel comprising:
a plurality of rows each including:
a scanning signal line;
switching elements which are turned on and off with use of said scanning signal line;
pixel electrodes each connected to a first terminal of a corresponding one of the switching elements; and
a capacity coupling line capacitively coupled to the pixel electrodes; and
data signal lines each connected to a second terminal of a corresponding one of the switching elements on said each of the plurality of rows,
the display driving circuit driving the display panel to carry out a gradation display corresponding to a potential of each of the pixel electrodes,
the display driving circuit comprising:
a scanning signal line driving circuit which outputs a scanning signal for turning on the switching elements on said each of the plurality of rows during a corresponding one of horizontal scanning periods which are sequentially allocated to the respective plurality of rows;
a data signal line driving circuit which outputs a data signal having a polarity that is, (i) to carry out line inversion driving, reversed in sync with a vertical scanning period, identical for all pixels on each of the plurality of rows, and reversed between any adjacent two of the plurality of rows, and (ii) to carry out frame inversion driving, reversed in sync with the vertical scanning period and identical for all pixels for an identical frame;
a capacity coupling line driving circuit which, after the horizontal scanning period for said each of the plurality of rows, outputs a potential shift signal having a potential that is switched between two values in a direction determined in accordance with the polarity of the data signal which polarity corresponds to the horizontal scanning period; and
a determining circuit which determines whether the data signal line driving circuit is carrying out the line inversion driving or the frame inversion driving,
the capacity coupling line driving circuit outputting the potential shift signal so that only when the determining circuit has determined that the data signal line driving circuit is carrying out the line inversion driving, the potential of the potential shift signal at timing at which the switching elements on said each of the plurality of rows are turned off is different between (i) said each of the plurality of rows and (ii) a row adjacent to said each of the plurality of rows, during a first vertical scanning period in which the data signal corresponding to a video image to be displayed starts to be outputted,
wherein:
the capacity coupling line driving circuit outputs the potential shift signal so that during the line inversion driving, the potential of the potential shift signal on said each of the plurality of rows is different between (i) timing at which the switching elements on said each of the plurality of rows are turned off and (ii) timing at which the switching elements on a row subsequent to said each of the plurality of rows are turned on;
the capacity coupling line driving circuit includes:
a first input section which receives (i) a scanning signal on said each of the plurality of rows and (ii) a scanning signal on the row subsequent to said each of the plurality of rows;
a second input section which receives a polarity signal having (i) a potential that corresponds to the potential of the potential shift signal and (ii) a polarity that is reversed in sync with the horizontal scanning period for said each of the plurality of rows; and
an output section which outputs the potential shift signal for said each of the plurality of rows; and
the capacity coupling line driving circuit during the line inversion driving outputs (i) a first potential shift signal having a first potential, the first potential shift signal having a polarity identical to a first polarity of the polarity signal being inputted to the second input section when the scanning signal on said each of the plurality of rows is inputted to the first input section, and (ii) a second potential shift signal having a second potential, the second potential shift signal having a polarity identical to a second polarity of the polarity signal being inputted to the second input section when the scanning signal on the row subsequent to said each of the plurality of rows is inputted to the first input section.

2. The display driving circuit according to claim 1,
wherein:
the capacity coupling line driving circuit comprises a D-latch circuit.

3. A display device comprising:
the display driving circuit recited in claim 1; and
the display panel.

4. The display device according to claim 3,
wherein:
the display device is a liquid crystal display device.

5. A display driving circuit for driving a display panel,
the display panel comprising:
a plurality of rows each including:
a scanning signal line;

switching elements which are turned on and off with use of said scanning signal line;

pixel electrodes each connected to a first terminal of a corresponding one of the switching elements; and a capacity coupling line capacitively coupled to the pixel electrodes; and data signal lines each connected to a second terminal of a corresponding one of the switching elements on said each of the plurality of rows, the display driving circuit driving the display panel to carry out a gradation display corresponding to a potential of each of the pixel electrodes, the display driving circuit comprising:

a scanning signal line driving circuit which outputs a scanning signal for turning on the switching elements on said each of the plurality of rows during a corresponding one of horizontal scanning periods which are sequentially allocated to the respective plurality of rows;

a data signal line driving circuit which outputs a data signal having a polarity that is, (i) to carry out line inversion driving, reversed in sync with a vertical scanning period, identical for all pixels on each of the plurality of rows, and reversed between any adjacent two of the plurality of rows, and (ii) to carry out frame inversion driving, reversed in sync with the vertical scanning period and identical for all pixels for an identical frame;

a capacity coupling line driving circuit which, after the horizontal scanning period for said each of the plurality of rows, outputs a potential shift signal having a potential that is switched between two values in a direction determined in accordance with the polarity of the data signal which polarity corresponds to the horizontal scanning period; and a determining circuit which determines whether the data signal line driving circuit is carrying out the line inversion driving or the frame inversion driving, the capacity coupling line driving circuit outputting the potential shift signal so that only when the determining circuit has determined that the data signal line driving circuit is carrying out the line inversion driving, the potential of the potential shift signal at timing at which the switching elements on said each of the plurality of rows are turned off is different between (i) said each of the plurality of rows and (ii) a row adjacent to said each of the plurality of rows, during a first vertical scanning period in which the data signal corresponding to a video image to be displayed starts to be outputted, wherein:

the capacity coupling line driving circuit outputs the potential shift signal so that during the line inversion driving, the potential of the potential shift signal in an initial state is different between any adjacent two of the plurality of rows, the display driving circuit further comprising:

a control circuit which controls the signal line driving circuit and the capacity coupling line driving circuit, wherein:

the control circuit outputs, to the capacity coupling line driving circuit, a control signal having a potential that (i) is different between any adjacent two of the plurality of rows, and that (ii) corresponds to the polarity signal having a polarity that is reversed in sync with the horizontal scanning period for said each of the plurality of rows, so that during the line inversion driving, the potential of the potential shift signal in the initial state is different between any adjacent two of the plurality of rows.

6. The display driving circuit according to claim 5, wherein:

the control circuit during the line inversion driving outputs (i) a first control signal if the polarity signal has a first polarity when a scanning signal on said each of the plurality of rows is turned on during the first vertical scanning period, and (ii) a second control signal if the polarity signal has a second polarity when the scanning signal on said each of the plurality of rows is turned on during the first vertical scanning period.

7. The display driving circuit according to claim 6, wherein:

the capacity coupling line driving circuit comprises a D-latch circuit; and the control circuit during the line inversion driving outputs, to the capacity coupling line driving circuit, (i) a reset signal as the first control signal if the polarity signal has a negative polarity when the scanning signal on said each of the plurality of rows is turned on during the first vertical scanning period, and (ii) a set signal as the second control signal if the polarity signal has a positive polarity when the scanning signal on said each of the plurality of rows is turned on during the first vertical scanning period.

8. The display driving circuit according to claim 5, wherein:

the capacity coupling line driving circuit includes:

a first input section which receives a scanning signal on a row subsequent to said each of the plurality of rows;

a second input section which receives a polarity signal having (i) a potential that corresponds to the potential of the potential shift signal and (ii) a polarity that is reversed in sync with the horizontal scanning period for each of the plurality of rows; and an output section which outputs the potential shift signal for said each of the plurality of rows; and the capacity coupling line driving circuit during the line inversion driving switches the potential of the potential shift signal in accordance with the polarity of the polarity signal being inputted to the second input section when the scanning signal on the row subsequent to said each of the plurality of rows is inputted to the first input section.

9. A display driving method for driving a display panel, the display panel comprising:

a plurality of rows each including:

a scanning signal line;

switching elements which are turned on and off with use of said scanning signal line;

pixel electrodes each connected to a first terminal of a corresponding one of the switching elements; and a capacity coupling line capacitively coupled to the pixel electrodes; and data signal lines each connected to a second terminal of a corresponding one of the switching elements on said each of the plurality of rows, the display driving method driving the display panel to carry out a gradation display corresponding to a potential of each of the pixel electrodes, the display driving method comprising:

(a) a scanning signal line driving step for outputting a scanning signal for turning on the switching elements on said each of the plurality of rows during a corresponding one of horizontal scanning periods which are sequentially allocated to the respective plurality of rows;

(b) a data signal line driving step for outputting a data signal having a polarity that is, (i) to carry out line inversion driving, reversed in sync with a vertical scanning period, identical for all pixels on each of the plurality of rows, and reversed between any adjacent two of the plurality of rows, and (ii) to carry out frame inversion driving, reversed in sync with the vertical scanning period and identical for all pixels for an identical frame;

(c) a capacity coupling line driving step for outputting, after the horizontal scanning period for said each of the plurality of rows, a potential shift signal having a potential that is switched between two values in a direction determined in accordance with the polarity of the data signal which polarity corresponds to the horizontal scanning period; and (d) a determining step for determining whether the line inversion driving or the frame inversion driving is being carried out in the step (b), the capacity coupling line driving step outputting the potential shift signal so that only when it is determined in the step (d) that the line inversion driving is being carried out in the step (b), the potential of the potential shift signal at timing at which the switching elements on said each of the plurality of rows are turned off is different between (i) said each of the plurality of rows and (ii) a row adjacent to said each of the plurality of rows, during a first vertical scanning period in which the data signal corresponding to a video image to be displayed starts to be outputted, wherein:

the capacity coupling line driving step outputs the potential shift signal so that during the line inversion driving, the potential of the potential shift signal on said each of the plurality of rows is different between (i) timing at which the switching elements on said each of the plurality of rows are turned off and (ii) timing at which the switching elements on a row subsequent to said each of the plurality of rows are turned on;

the capacity coupling line driving step includes:

receiving (i) a scanning signal on said each of the plurality of rows and (ii) a scanning signal on the row subsequent to said each of the plurality of rows;

receiving a polarity signal having (i) a potential that corresponds to the potential of the potential shift signal and (ii) a polarity that is reversed in sync with the horizontal scanning period for said each of the plurality of rows; and outputting the potential shift signal for said each of the plurality of rows; and the capacity coupling line driving step during the line inversion driving outputs (i) a first potential shift signal having a first potential, the first potential shift signal having a polarity identical to a first polarity of the polarity signal being inputted to the second input section when the scanning signal on said each of the plurality of rows is inputted to the first input section, and (ii) a second potential shift signal having a second potential, the second potential shift signal having a polarity identical to a second polarity of the polarity signal being inputted to the second input section when the scanning signal on the row subsequent to said each of the plurality of rows is inputted to the first input section.

10. A display driving method for driving a display panel, the display panel comprising:

a plurality of rows each including:

a scanning signal line;

switching elements which are turned on and off with use of said scanning signal line;

pixel electrodes each connected to a first terminal of a corresponding one of the switching elements; and a capacity coupling line capacitively coupled to the pixel electrodes; and data signal lines each connected to a second terminal of a corresponding one of the switching elements on said each of the plurality of rows, the display driving method driving the display panel to carry out a gradation display corresponding to a potential of each of the pixel electrodes, the display driving method comprising:

(a) a scanning signal line driving step for outputting a scanning signal for turning on the switching elements on said each of the plurality of rows during a corresponding one of horizontal scanning periods which are sequentially allocated to the respective plurality of rows;

(b) a data signal line driving step for outputting a data signal having a polarity that is, (i) to carry out line inversion driving, reversed in sync with a vertical scanning period, identical for all pixels on each of the plurality of rows, and reversed between any adjacent two of the plurality of rows, and (ii) to carry out frame inversion driving, reversed in sync with the vertical scanning period and identical for all pixels for an identical frame;

(c) a capacity coupling line driving step for outputting, after the horizontal scanning period for said each of the plurality of rows, a potential shift signal having a potential that is switched between two values in a direction determined in accordance with the polarity of the data signal which polarity corresponds to the horizontal scanning period; and (d) a determining step for determining whether the line inversion driving or the frame inversion driving is being carried out in the step (b), the capacity coupling line driving step outputting the potential shift signal so that only when it is determined in the step (d) that the line inversion driving is being carried out in the step (b), the potential of the potential shift signal at timing at which the switching elements on said each of the plurality of rows are turned off is different between (i) said each of the plurality of rows and (ii) a row adjacent to said each of the plurality of rows, during a first vertical scanning period in which the data signal corresponding to a video image to be displayed starts to be outputted, wherein:

the capacity coupling line driving step outputs the potential shift signal so that during the line inversion driving, the potential of the potential shift signal in an initial state is different between any adjacent two of the plurality of rows, the display driving method further comprising:

a control step which controls the signal line driving step and the capacity coupling line driving step, wherein:

the control step outputs, to the capacity coupling line driving step, a control signal having a potential that (i) is different between any adjacent two of the plurality of rows, and that (ii) corresponds to the polarity signal having a polarity that is reversed in sync with the horizontal scanning period for said each of the plurality of rows, so that during the line inversion driving, the potential of the potential shift signal in the initial state is different between any adjacent two of the plurality of rows.

* * * * *